US008445171B2

(12) United States Patent
Suzuki et al.

(10) Patent No.: US 8,445,171 B2
(45) Date of Patent: May 21, 2013

(54) TONER FOR ELECTROPHOTOGRAPHY AND METHOD OF PREPARING THE TONER

(75) Inventors: Kazumi Suzuki, Shizuoka-ken (JP); Yohichiroh Watanabe, Fuji (JP)

(73) Assignee: Ricoh Company, Limited, Tokyo (JP)

( * ) Notice: Subject to any disclaimer, the term of this patent is extended or adjusted under 35 U.S.C. 154(b) by 940 days.

(21) Appl. No.: 12/187,717

(22) Filed: Aug. 7, 2008

(65) Prior Publication Data

US 2009/0042118 A1 Feb. 12, 2009

(30) Foreign Application Priority Data

Aug. 7, 2007 (JP) ..... 2007-205325

(51) Int. Cl.
*G03G 5/00* (2006.01)

(52) U.S. Cl.
USPC ..... 430/137.1

(58) Field of Classification Search
USPC ..... 430/137.1
See application file for complete search history.

(56) References Cited

U.S. PATENT DOCUMENTS

| | | | | |
|---|---|---|---|---|
| 6,627,374 | B2 * | 9/2003 | Fumita et al. | 430/137.17 |
| 2003/0224271 | A1 * | 12/2003 | Teshima | 430/105 |
| 2006/0210909 | A1 * | 9/2006 | Ohtani | 430/137.1 |
| 2008/0063971 | A1 | 3/2008 | Watanabe et al. | |
| 2008/0248416 | A1 * | 10/2008 | Norikane et al. | 430/137.18 |

FOREIGN PATENT DOCUMENTS

| | | |
|---|---|---|
| JP | 53-132057 | 11/1978 |
| JP | 7-152202 | 6/1995 |
| JP | 3166369 | 3/2001 |
| JP | 2003-167379 | 6/2003 |
| JP | 2003-280236 | 10/2003 |
| JP | 2005-258394 | 9/2005 |
| JP | 3786034 | 3/2006 |
| JP | 3786035 | 3/2006 |
| JP | 2006-293320 | 10/2006 |
| JP | 2007-199463 | 8/2007 |

OTHER PUBLICATIONS

U.S. Appl. No. 12/036,706, filed Feb. 25, 2008, Kazumi Suzuki et al.

* cited by examiner

*Primary Examiner* — Thorl Chea
(74) *Attorney, Agent, or Firm* — Oblon, Spivak, McClelland, Maier & Neustadt, L.L.P.

(57) ABSTRACT

A method of preparing a toner, including dripping a toner constituent liquid comprising an organic solvent; and toner constituents comprising a resin and a colorant, which are dissolved or dispersed in the organic solvent through a nozzle to form a droplet; and removing the organic solvent from the droplet, wherein the droplet is dried while contacted with a first de-solvent gas comprising steam in a pre-heated period and at least a part of a constant-rate drying period, or the droplet is dried at least in a pre-heated period and a constant-rate drying period, which include two stages including a first stage and a second stage, wherein the droplet is contacted with the first de-solvent gas including steam in the first stage and a second de-solvent gas having a dew point not greater than −10° C. under ordinary pressure in the second stage.

4 Claims, 17 Drawing Sheets

TONER FOR ELECTROPHOTOGRAPHY AND METHOD OF PREPARING THE TONER

BACKGROUND OF THE INVENTION

1. Field of the Invention

The present invention relates to a toner for electrophotography, and more particularly to a method of preparing a toner by dripping a toner constituent liquid through a nozzle.

2. Discussion of the Background

Recently, the electrophotographic copiers or printers are required to produce images having higher quality. In order to satisfy this requirement, toners are actively studied to have smaller particle diameters.

Conventionally, pulverization methods of melting and kneading a binder resin and a colorant to prepare a kneaded mixture, pulverizing the kneaded mixture and classifying the pulverized mixture have been used. However, the pulverization methods prepare toners having wide particle diameter distributions, and have limitations of technically reducing diameter and of productivity such as yield.

Recently, polymerized toners prepared by suspension polymerization methods, emulsion polymerization condensation methods, etc. are being used. Besides, Japanese published unexamined application No. 7-152202 discloses a polymer solution suspension method of using a volume contraction. This method includes dispersing or dissolving toner constituents in a volatile solvent such as an organic solvent having a low boiling point to prepare a dispersion or a solution, emulsifying the dispersion or solution in an aqueous medium to form a droplet, and removing the volatile solvent. The diversity of resins this method can use is wider than those of the suspension polymerization methods and emulsion polymerization condensation methods, and has an advantage of being capable of using a polyester resin effectively used for full-color images requiring transparency and smoothness.

However, in the polymerization methods, since a dispersant is basically used in an aqueous medium, the dispersant impairing the chargeability of a toner remains on the surface thereof, resulting in deterioration of environmental resistance. In addition, a large amount of water is needed to remove the dispersant, resulting in unsatisfactory methods of preparing a toner.

Japanese published unexamined application No. 2003-262976 discloses a method and an apparatus forming a microscopic droplet with a piezoelectric pulse, and drying and solidifying the microscopic droplet to form a toner. Further, Japanese published unexamined application No. 2003-280236 discloses a method of forming a microscopic droplet with a heat expansion in a nozzle, and drying and solidifying the microscopic droplet to form a toner. Further, Japanese published unexamined application No. 2003-262977 discloses a method of forming a microscopic droplet with an acoustic lens, and drying and solidifying the microscopic droplet to form a toner.

In these methods of spraying microscopic droplets, organic solvents having small latent heats are energetically preferably used in a solution or a dispersion to be sprayed. However, the organic solvents remaining in the resultant powder are very difficult to remove.

Because of these reasons, a need exists for a method of spraying a toner constituent liquid formed of toner constituents dissolved in an organic solvent to form a microscopic droplet and drying the microscopic droplet to form a toner, which is capable of drying the microscopic droplet at low cost and short times.

SUMMARY OF THE INVENTION

Accordingly, an object of the present invention is to provide a method of spraying a toner constituent liquid formed of toner constituents dissolved in an organic solvent to form a microscopic droplet and drying the microscopic droplet to form a toner, which is capable of drying the microscopic droplet at low cost and short times.

Another object of the present invention is to provide a toner prepared by the method.

A further object of the present invention is to provide an image forming apparatus using the toner.

Another object of the present invention is to provide a process cartridge using the toner.

These objects and other objects of the present invention, either individually or collectively, have been satisfied by the discovery of a method of preparing a toner, comprising:

dripping a toner constituent liquid comprising:

an organic solvent; and toner constituents comprising a resin and a colorant, which are dissolved or dispersed in the organic solvent through a nozzle to form a droplet; and removing the organic solvent from the droplet, wherein the droplet is dried while contacted with a de-solvent gas comprising steam in a pre-heated period and at least a part of a constant-rate drying period.

In addition, a method of preparing a toner, comprising:

dripping a toner constituent liquid comprising:

an organic solvent; and toner constituents comprising a resin and a colorant, which are dissolved or dispersed in the organic solvent through a nozzle to form a droplet; and removing the organic solvent from the droplet, wherein the droplet is dried at least in a pre-heated period and a constant-rate drying period, which comprise two stages comprising a first stage and a second stage, wherein the droplet is contacted with a first de-solvent gas comprising steam in the first stage and a second de-solvent gas having a dew point not greater than −10° C. under ordinary pressure in the second stage.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
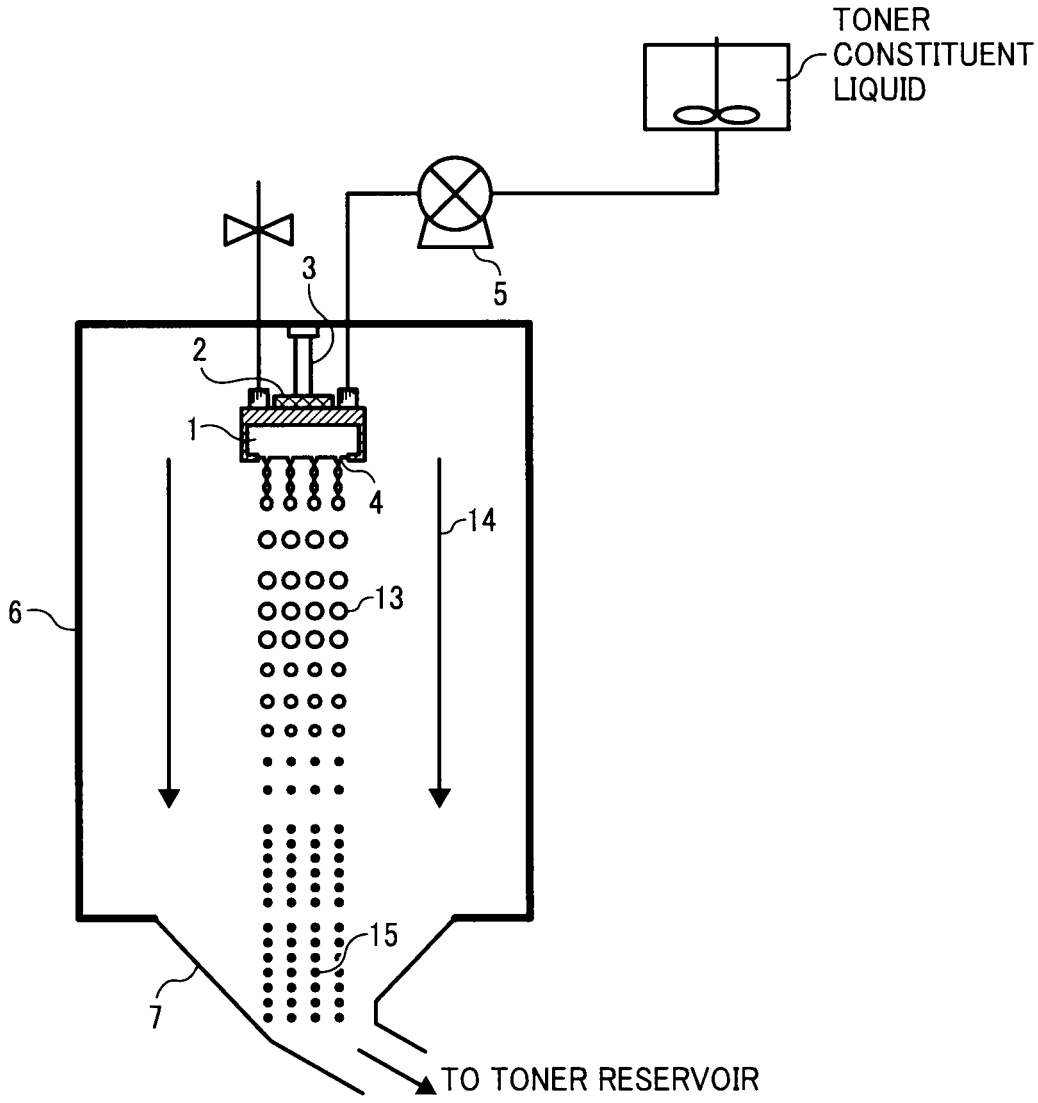
FIG. 1 is a schematic view illustrating an embodiment of the toner preparation apparatus of the present invention.

The present invention provides a method of spraying a toner constituent liquid formed of toner constituents dissolved in an organic solvent to form a microscopic droplet and drying the microscopic droplet to form a toner, which is capable of drying the microscopic droplet at low cost and short times.

Particularly, the present invention provides a method of preparing a toner, comprising:

dripping a toner constituent liquid comprising:

an organic solvent; and toner constituents comprising a resin and a colorant, which are dissolved or dispersed in the organic solvent through a nozzle to form a droplet; and removing the organic solvent from the droplet, wherein the droplet is dried while contacted with a de-solvent gas comprising steam in a pre-heated period and at least a part of a constant-rate drying period.

In addition, the present invention provides a method of preparing a toner, comprising:

dripping a toner constituent liquid comprising:

an organic solvent; and toner constituents comprising a resin and a colorant, which are dissolved or dispersed in the organic solvent through a nozzle to form a droplet; and removing the organic solvent from the droplet, wherein the droplet is dried at least in a pre-heated period and a constant-rate drying period, which comprise two stages comprising a first stage and a second stage, wherein the droplet is contacted with a first de-solvent gas comprising steam in the first stage and a second de-solvent gas having a dew point not greater than −10° C. under ordinary pressure in the second stage.

The toner constituents in the present invention includes at least a resin and a colorant, and other components such as an organic low-molecular-weight material, an external additive and a charge controlling agent when needed.

Hereinafter, the toner constituents will be explained.

The resin includes at least a binder resin.

The binder resins are not particularly limited, and conventionally-used resins can be used alone or in combination. The binder resin preferably includes a gel component insoluble in the solvent in an amount less than 0.5%. The gel component clogs the spray nozzle and deteriorates the productivity. When a resin including a gel component is used, the gel component is filtered after the resin is dissolved. In addition, the resin composition can control the shape of a toner, and locations of a wax and a pigment therein.

Specific examples of the resins include vinyl polymers including styrene monomers, acrylic monomers or methacrylic monomers, or copolymers including two or more of the monomers; polyester polymers; a polyol resin; a phenol resin; a silicone resin; a polyurethane resin; a polyamide resin; a furan resin; an epoxy resin; a xylene resin; a terpene resin; a coumarone-indene resin; a polycarbonate resin; a petroleum resin; etc.

Specific examples of the styrene monomers include styrenes or their derivatives such as styrene, o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dochlorostyrne, m-nitrostyrene, o-nitrostyrene and p-nitrostyrene.

Specific examples of the acrylic monomers include an acrylic acid or their esters such as methylacrylate, ethylacrylate, n-butylacrylate, isobutylacrylate, n-octylacrylate, n-dodecylacrylate, 2-ethylhexylacrylate, stearylacrylate, 2-chloroethylacrylate and phenylacrylate.

Specific examples of the methacrylic monomers include a methacrylic acid or their esters such as a methacrylic acid, methylmethacrylate, ethylmethacrylate, propylmethacrylate, n-butylmethacrylate, isobutylmethacrylate, n-octylmethacrylate, n-dodecylmethacrylate, 2-ethylhexylmethacrylate, stearylmethacrylate, phenylmethacrylate, dimethylaminoethylmethacrylate and diethylaminoethylmethacrylate.

Specific examples of other monomers forming the vinyl polymers or copolymers include the following materials (1) to (18):

(1) monoolefins such as ethylene, propylene, butylene and isobutylene; (2) polyenes such as butadiene and isoprene; (3) halogenated vinyls such as vinylchloride, vinylidenechloride, vinylbromide and vinylfluoride; (4) vinyl esters such as vinylacetate, vinylpropionate and vinylbenzoate; (5) vinylethers such as vinylmethylether, vinylethylether and vinylisobutylether; (6) vinylketones such as vinylmethylketone, vinylhexylketone and methyl isopropenylketone; (7) N-vinyl compounds such as N-vinylpyrrole, N-vinylcarbazole, N-vinylindole and N-vinylpyrrolidone; (8) vinylnaphthalenes; (9) acrylic acid or methacrylic acid derivatives such as acrylonitrile, methacrylonitrile and acrylamide; (10) unsaturated diacids such as a maleic acid, a citraconic acid, an itaconic acid, an alkenylsuccinic acid, a fumaric acid and a mesaconic acid; (11) unsaturated diacid anhydrides such as a maleic acid anhydride, a citraconic acid anhydride, an itaconic acid anhydride and an alkenylsuccinic acid anhydride; (12) monoesters of unsaturated diacids such as monomethylester maleate, monoethylester maleate, monobutylester maleate, monomethylester citraconate, monoethylester citraconate, monobutylester citraconate, monomethylester itaconate, monomethylester alkenylsuccinate, monomethylester fumarate and monomethylester mesaconate; (13) esters of unsaturated diacids such as a dimethyl maleic acid and a dimethyl fumaric acid; (14) α,β-unsaturated acids such as a crotonic acid and a cinnamic acid; (15) α,β-unsaturated acid anhydrides such as crotonic acid anhydride and a cinnamic acid anhydride; (16) monomers having a carboxyl group, such as anhydrides of the α,β-unsaturated acids and lower fatty acids, an alkenylmalonic acid, alkenylglutaric acid alkenyladipic acid, their anhydrides and monoesters; (17) hydroxyalkylester acrylates or methacrylates such as 2-hydroxyethylacrylate, 2-hydroxyethylmethacrylate and 2-hydroxypropylmethacrylate; and (18) monomers having a hydroxy group such as 4-(1-hydroxy-1-methylbutyl)styrene and 4-(1-hydroxy-1-methylhexyl)styrene.

The vinyl polymer or copolymer of the binder resin may have a crosslinked structure formed by a crosslinker having 2 or more vinyl groups. Specific examples of the crosslinker include aromatic divinyl compounds such as divinylbenzene and divinylnaphthalene; diacrylate compounds bonded with an alkyl chain, such as ethyleneglycoldiacrylate, 1,3-butyleneglycoldiacrylate, 1,4-butanedioldiacrylate, 1,5-pentanedioldiacrylate, 1,6-hexanedildiacrylate, neopentylglycoldiacrylate or their dimethacrylates; and diacrylate compounds bonded with an alkyl chain including an ester bond, such as diethyleneglycoldiacrylate, triethyleneglycoldiacrylate, tetraethyleneglycoldiacrylate, polyethyleneglycoldiacrylate#400, polyethyleneglycoldiacrylate#600, dipropyleneglycoldiacrylate or their dimethacrylates.

Diacrylate or dimethacrylate compounds bonded with a chain including an aromatic group and an ether bond can also be used. Polyester diacrylates include a product named MANDA from NIPPON KAYAKU CO., LTD.

Specific examples of a multifunctional crosslinker include pentaerythritoltriacrylate, trimethylolethanetriacrylate, trimethylolpropanetriacrylate, tetramethylolmethanetetraacrylate, oligoesteracrylate and their methacrylates, triallylcyanurate and triallyltrimellitate.

The toner preferably includes the crosslinker in an amount of 0.001 to 10 parts by weight, more preferably from 0.03 to 5 parts by weight based on total weight of the monomer. Among these crosslinking monomers, the aromatic divinyl compounds, particularly the divinylbenzene and the diacrylate compounds bonded with a bonding chain including an aromatic group and an ether bond are preferably used in terms of the fixability and offset resistance of the resultant toner. Further, styrene copolymers and styrene-acrylic copolymers are more preferably used.

Specific examples of a polymerization initiator used for preparing the vinyl polymer or copolymer include azo polymerization initiators such as 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(cyclohexanecarbonitrile), 2-(carbamoylazo)-isobutyronitrile, 2,2'-azobis(2,4,4-trimethylpentane), 2-phenylazo-2',4'-fimethyl-4'-methoxyvaleronitrile and 2,2'-azobis (2-methylpropane); ketone peroxides such as methyl ethyl ketone peroxide, acetylacetone peroxide and cyclohexanone peroxide; 2,2-bis(tert-butylperoxy)butane; tert-butylhydroperoxide; cumenehydroperoxide; 1,1,3,3-tetramethylbutylhydroperoxide; di-tert-butylperoxide; tert-butylcumylperoxide; di-cumylperoxide; α-(tert-butylperoxy)isopropylbenzene; isobutylperoxide; octanoylperoxide; decanoylperoxide; lauroylperoxide; 3,5,5-trimethylhexanoylperoxide; benzoylperoxide; m-tolylperoxide; di-isopropylperoxydicarbonate; di-2-ethylhexylperoxydicarbonate; di-n-propylperoxydicarbonate; di-2-ethoxyethylperoxycarbonate; di-ethoxyisopropylperoxydicarbonate; di(3-methyl-3-methoxybutyl)peroxycarbonate; acetylcyclohexylsulfonylperoxide; tert-butylperoxyacetate; tert-butylperoxyisobutylate; tert-butylperoxy-2-ethylhexylate; tert-butylperoxylaurate; tert-butyloxybenzoate; tert-butylperoxyisopropylcarbonate; di-tert-butylperoxyisophthalate; tert-butylperoxyallylcarbonate; isoamylperoxy-2-ethylhexanoate; di-tert-butylperoxyhexahydroterephthalate; tert-butylperoxyazelate; etc.

When the binder resin is selected from styrene-acrylic resins, the binder resin preferably includes elements soluble with tetrahydrofuran (THF), having a weight-average molecular weight of from $8.0\times10^3$ to $5.0\times10^4$ in a molecular weight distribution by GPC thereof in terms of the fixability, offset resistance and storage stability of the resultant toner. When less than $8.0\times10^3$, the residual solvent can be reduced but the offset resistance and storage stability of the resultant toner deteriorate. When greater than $5.0\times10^4$, it is difficult to make the residual solvent value not greater than 200 ppm.

When the binder resin is selected from vinyl polymers such as styrene-acrylic resins, the binder resin preferably has an acid value of from 0.1 to 100 mg KOH/g, more preferably from 0.1 to 70 mg KOH/g, and much more preferably from 0.1 to 50 mg KOH/g.

Specific examples of monomers forming polyester polymers include the following materials.

Specific examples of bivalent alcohol include diols such as ethyleneglycol, propyleneglycol, 1,3-butanediol, 1,4-butanediol, 2,3-butanediol, 1,4-butenediol, diethyleneglycol, triethyleneglycol, 1,5-pentanediol, 1,6-hexanediol, neopentylglycol, 2-ethyl-1,3-hexanediol, and diols formed by polymerizing hydrogenated bisphenol A or bisphenol A with cyclic ethers such as an ethylene oxide and a propylene oxide.

In order to crosslink polyester resins, alcohol having 3 valences or more is preferably used together.

Specific examples of polyalcohol having 3 or more valences include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxybenzene, etc.

Specific examples of acids forming the polyester polymers include benzene dicarboxylic acids or their anhydrides such as a phthalic acid, an isophthalic acid and a terephthalic acid; alkyl dicarboxylic acids or their anhydrides such as a succinic acid, an adipic acid, a sebacic acid and an azelaic acid; unsaturated diacids such as a maleic acid, a citraconic acid, an itaconic acid, an alkenylsuccinic acid, a fumaric acid and a mesaconic acid; and unsaturated diacid anhydrides such as a maleic acid anhydride, a citraconic acid anhydride, an itaconic acid anhydride and an alkenylsuccinic acid anhydride; etc. Specific examples of polycarboxylic acids having 3 or more valences include a trimellitic acid, a pyromellitic acid, a 1,2,4-benzenetricarboxylic acid, a 1,2,5-benzenetricarboxylic acid, a 2,5,7-naphthalenetricarboxylic acid, a 1,2,4-naphthalenetricarboxylic acid, a 1,2,4-butanetricarboxylic acid, a 1,2,5-hexanetricarboxylic acid, a 1,3-dicarboxyl-2-methylmethylenecarboxypropane, tetra(methylenecarboxyl)methane, 1,2,7,8-octantetracarboxylic acids, empol trimer or their anhydrides, or those partially replaced with lower alkyl esters, etc.

When the binder resin is selected from polyester resins, the binder resin preferably includes elements soluble with tetrahydrofuran (THF), having a weight-average molecular weight of from $8.0\times10^3$ to $5.0\times10^4$ in a molecular weight distribution by GPC thereof in terms of the fixability, offset resistance and storage stability of the resultant toner. When less than $8.0\times10^3$, the residual solvent can be reduced but the offset resistance and storage stability of the resultant toner deteriorate. When greater than $5.0\times10^4$, it is difficult to make the residual solvent value not greater than 200 ppm.

When the binder resin is selected from polyester resins, the binder resin preferably has an acid value of from 0.1 to 100 mg KOH/g, more preferably from 5 to 70 mg KOH/g, and much more preferably from 10 to 50 mg KOH/g.

In the present invention, the molecular weight distribution of the binder resin is measured by gel permeation chromatography (GPC) using THF as a solvent.

In the vinyl polymers and/or polyester resins, resins including monomers reactable therewith can be used. Specific examples of the monomers forming the polyester resin, reactable with the vinyl polymer include unsaturated dicarboxylic acids or their anhydrides such as a phthalic acid, a maleic acid, a citraconic acid and an itaconic acid. Specific examples of the monomers forming the vinyl polymer include monomers having a carboxyl group or a hydroxy group, and an acrylic acid or ester methacrylates.

When the polyester polymer, vinyl polymer and other binder resins are used together, the united resins preferably includes resins having an acid value of from 0.1 to 50 mgKOH/g in an amount of 60% by weight.

In the present invention, the acid value of the binder resin can be measured according to JIS K-0070 as follows.

(1) Additives besides the binder resin (polymer) are removed from a sample or an acid value and a content of the additives besides the binder resin are measured before measured. 0.5 to 2.0 g of the sample is precisely weighed and the weight of the polymer is W g. For example, when the acid value of a binder resin in a toner is measured, the acid value and content of a colorant or a magnetic material are measured beforehand, and the acid value of the binder resin is calculated.

(2) The samples is dissolved with 150 ml of a mixture of toluene/ethanol (volume ratio 4/1) to prepare a solution in a beaker having a capacity of 300 ml.

(3) The solution is titrated with a potentiometric titrator using an ethanol solution 0.1 mol/l KOH.

(4) The usage of the ethanol solution is S (ml), and at the same time, the usage thereof without the sample is B (ml) and the acid value is determined by the following formula:

$$\text{acid value (mg KOH/g)}=[(S-B)\times f\times 5.61]/W$$

wherein f is a factor of KOH.

The binder resin and constituents including the binder resin of the toner preferably has a glass transition temperature of from 35 to 80° C., and more preferably from 40 to 75° C. in terms of the storage stability of the resultant toner. When lower than 35° C., the resultant toner is likely to deteriorate in an environment of high temperature, and have offset problems when fixed. When higher than 80° C., the fixability thereof occasionally deteriorates.

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and their mixtures.

The toner preferably includes the colorant in an amount of from 1 to 15% by weight, and more preferably from 3 to 10% by weight.

Specific examples of methods of dispersing the colorant for use in the present invention include, but are not limited to, a method of mixing and kneading the colorant with a resin upon application of high shearing strength or a method of previously dispersing the colorant with a dispersant in a solvent, etc. Dispersers having high shearing strength such as three-roll mills are preferably used. Beads mills are preferably used when dispersing the colorant in a solvent. The colorant preferably has a particle diameter not greater than 1 μm in a dispersion after dispersed therein. The colorant having a particle diameter greater than 1 μm is likely to clog the spray nozzle. A toner including such a colorant is likely to produce images having poorer quality, particularly, produce images deteriorating the light transmission of an OHP when produced thereon. The colorant more preferably has a particle diameter not greater than 300 nm, which largely improves the light transmission and color reproducibility. The particle diameter of the colorant can be measured by the laser diffraction particle diameter distribution measurer LA-920 from Horiba, Ltd.

Specific examples of the resins dispersed with the colorant include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

Specific examples of organic low-molecular-weight materials optionally included in the toner constituents include aromatic acid esters such as a fatty acid ester and a phthalic acid; phosphate ester; maleic acid ester; fumaric acid ester; itaconic acid ester; other esters; ketones such as benzyl, benzoin compounds and benzoyl compounds; hindered phenol compounds; benzotriazole compounds; aromatic sulfonamide compounds; fatty amide compounds; long-chain alcohols; long-chain dialcohols; long-chain carboxylic acids; long-chain dicarboxylic acids; etc.

These specifically include dimethylfumarate, monoethylfumarate, monobutylfumarate, monomethylitaconate, diphenyladipate, dibenzylterephthalate, dibenzylisophthalate, benzyl, benzoinisopropylether, 4-benzoylbiphenyl, 4-benzoyldiphenylether, 2-benzoylnaphthalene, dibenzoylmethane, 4-biphenylcarboxylic acid, stearyl amide stearate, oleyl amide stearate, stearic amide oleate, octadecanol, n-octylalcohol, tetracosanoic acid, eicosanoic acid, stearic acid, lauric acid, nonadecanoic acid, palmitic acid, hydroxy octanoic acid, docosanoic acid, the compounds disclosed in Japanese published unexamined application No. 2002-105414, having the formulae (1) to (17), etc.

Further, natural waxes, e.g., plant waxes such as carnauba wax, cotton wax, Japan wax and rice wax; animal waxes such as bees wax and lanolin; mineral waxes such as ozokerite and ceresin; petroleum waxes such as paraffin, microcrystalline and petrolatum can also be included in the toner constituents. Further, fatty acid amides such as hydroxy stearic acid amide, stearic acid amide, acid phthalic anhydride amide and chlorinated hydrocarbon; homopolymers of polyacrylate which are low-molecular-weight crystalline polymeric resins such as poly-n-stearylmethacrylate and poly-n-laurylmethacrylate or copolymer of the polyacrylate such as n-stearylacrylate-ethylmethacrylate copolymer; crystalline polymers having long side-chain alkyl groups; etc. can also be used.

These can be used alone or in combination.

When the resin and the organic low-molecular-weight material are compatible at a temperature not lower than a melting point of the organic low-molecular-weight material, the organic low-molecular-weight material works as a plasticizer. Namely, the organic low-molecular-weight material improves a softening point of the resin such that the resultant toner has good low-temperature fixability. In this case, the organic low-molecular-weight material preferably has a melting point not higher than 120° C., and more preferably not higher than 80° C. When higher than 120° C., low-temperature fixability of the resultant toner is not improved.

When the resin and the organic low-molecular-weight material are not compatible, the organic low-molecular-weight material works as a release agent. In this case, the organic low-molecular-weight material preferably has a melting point not higher than 100° C., and more preferably not higher than 80° C. When higher than 100° C., cold offset is likely to occur when toner images are fixed.

The organic low-molecular-weight material preferably has a melting viscosity of from 5 to 1,000 cps, and more preferably from 10 to 100 cps at a temperature higher than a melting point thereof by 10° C.

When less than 5 cps, the releasability of the resultant toner occasionally deteriorates. When greater than 1,000 cps, it is likely that the hot offset resistance and low-temperature fixability of the resultant toner are not improved.

Specific examples of the organic solvents for use in the present invention includes ester solvents such as methyl acetate, ethyl acetate, isobutyl acetate, amyl acetate, ethyl lactate and ethylene carbonate; alcohol solvents such as methanol, ethanol, isopropanol, n-butanol and methylisocarbinol; hydrocarbon solvents including aromatic hydrocarbons such as benzene, toluene and xylene and fatty hydrocarbons such as hexane, heptane, iso-octane and cyclohexane. These can be combined as desired according to the present invention. Besides, ketones such as acetone, 2-butanone, ethyl amyl ketone, diacetone alcohol, isophorone and cyclohexanone; amides such as N,N-dimethylformamide and N,N-dimethylacetoamide; ethers such as diethylether, isopropylether, tetrahydrofuran, 1,4-dioxane and 3,4-dihydro-2H-pyran; glycolethers such as 2-methoxyethanol, 2-ethoxyethanol, 2-butoxyethanol and ethyleneglycoldimethylether; glycoletheracetates such as 2-methoxyethylacetate, 2-ethoxyethylacetate and 2-butoxyethylacetate; halogenated hydrocarbons such as methylene chloride, 1,2-dichlorethane, dichloropropane and chlorbenzene; sulfoxides such as dimethylsulfoxide; and pyrrolidones such as N-methyl-2-pyrrolidone and N-octyl-2-pyroolidone can also be used.

Other than the resin, organic low-molecular-weight material and colorant, an inorganic particulate material can be externally added to a toner to impart fluidity, developability and chargeability thereto.

Specific examples of the inorganic particulate material include known materials such as, but are not limited to, silica, alumina, titanium oxide, barium titanate, magnesium titanate, calcium titanate, strontium titanate, zinc oxide, tin oxide, quartz sand, clay, mica, sand-lime, diatomearth, chromiumoxide, cerium oxide, red iron oxide, antimony trioxide, magnesium oxide, zirconium oxide, barium sulfate, barium carbonate, calcium carbonate, silicon carbide, silicon nitride, etc. These can be used alone or in combination.

The inorganic particulate material preferably has a primary particle diameter of from 5 nm to 2 μm, and more preferably from 5 nm to 500 nm.

The inorganic particulate material is preferably included in a toner in an amount of from 0.01 to 5% by weight, and more preferably from 0.01 to 2.0% by weight based on total weight of the toner.

The inorganic particulate material can be treated with a surface treatment agent to increase the hydrophobicity to prevent deterioration of fluidity and chargeability even in an environment of high humidity of the resultant toner. Specific examples of the surface treatment agent include a silane coupling agent, a sililating agent, a silane coupling agent having an alkyl fluoride group, an organic titanate coupling agent, an aluminum coupling agent a silicone oil and a modified silicone oil.

The toner of the present invention may include a cleanability improver for removing a developer remaining on a photoreceptor and a first transfer medium after transferred. Specific examples of the cleanability improver include fatty acid metallic salts such as zinc stearate, calcium stearate and stearic acid; and polymer particulate materials prepared by a soap-free emulsifying polymerization method such as a polymethylmethacrylate particulate material and a polystyrene particulate material. The polymer particulate materials comparatively have a narrow particle diameter distribution and preferably have a volume-average particle diameter of from 0.01 to 1 μm.

Specific examples of the charge controlling agent include any known charge controlling agents, preferably colorless or almost white materials because of not changing the color tone of the toner, such as Nigrosine dyes, triphenylmethane dyes, metal complex dyes including chromium, molybdic acid chelate pigments, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, and metal salts of salicylic acid and of salicylic acid derivatives. These can be used alone or in combination.

Specific examples of marketed products of the charge controlling agents include a quaternary ammonium salt BONTRON P-51, a metal complex of oxynaphthoic acids E-82, a metal complex of salicylic acids E-84 and a phenolic condensation product E-89, which are manufactured by Orient Chemical Industries Co., Ltd.; molybdenum complex of quaternary ammonium salts TP-302 and TP-415, which are manufactured by Hodogaya Chemical Co. Ltd.; a quaternary ammonium salt COPY CHARGE PSY VP2038, a triphenyl methane derivative COPY BLUE, quaternary ammonium salts COPY CHARGE NEG VP2036 and NXVP434, which are manufactured by Hoechst AG; LRA-901 and a boron complex LR-147, which are manufactured by Japan Carlit Co., Ltd.; quinacridone; azo pigments; polymeric compounds having functional groups such as a sulfonic acid group, a carboxyl group and a quaternary ammonium salt; etc.

The content of the charge controlling agent is determined depending on the species of the binder resin used, whether or not an additive is added and toner manufacturing method (such as dispersion method) used, and is not particularly limited. However, the content thereof is typically from 0.1 to 10 parts by weight, and preferably from 0.2 to 5 parts by weight, per 100 parts by weight of the binder resin included in the toner. When less than 0.1 parts by weight, the chargeability of the resultant toner possibly deteriorates. When greater than 10 parts by weight, the toner has too large charge quantity, and thereby the electrostatic force of a developing roller attracting the toner increases, resulting in deterioration of the fluidity of the toner and image density of the toner images.

The method of preparing a toner of the present invention including dripping a solution or a dispersion formed of a solvent, and toner constituents including at least a resin and a colorant dissolved therein through a nozzle to form a droplet, and de-solventing the droplet is characterized by using steam for a de-solvent gas used for constant-rate drying of the droplet.

The constant-rate drying and falling-rate drying in the present invention will be explained.

Figure 29:
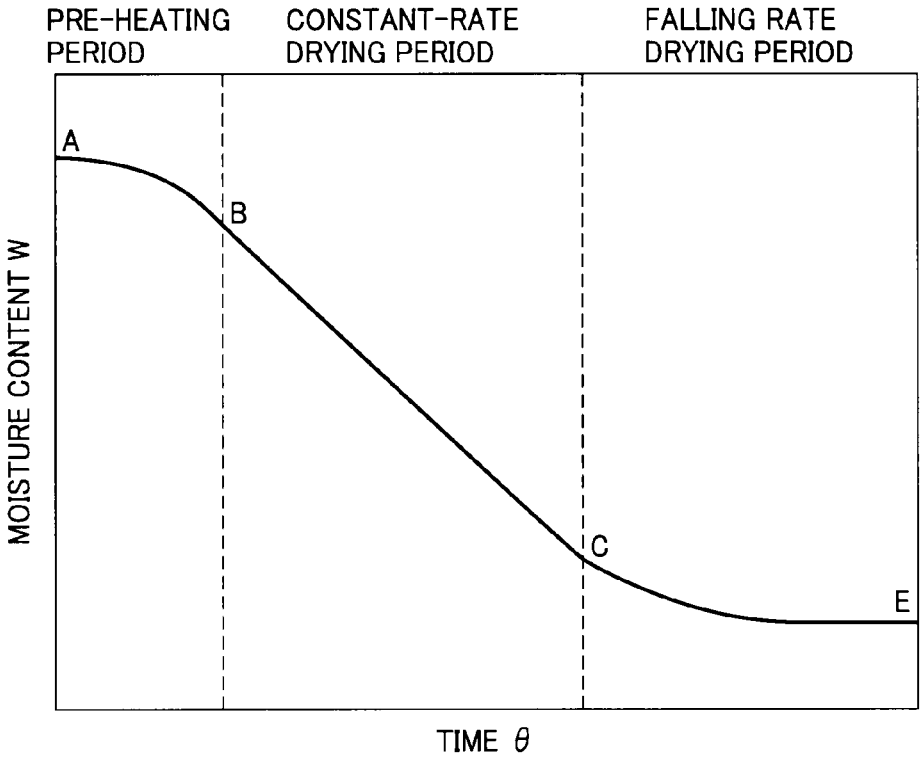
FIG. 29 is a chart for explaining a constant-rate drying period and a falling-drying-rate period.

Typically, when a material including moisture is dried by heating while contacted to a drying gas, a water content W and time θ have a relationship shown in FIG. 29.

Namely, when an initial pre-heating period (A→B) passes, a constant-rate drying period (B→C) where the water content W linearly decreases follows, and then a falling-rate drying period (C→E) where the water content W does not linearly decrease and is saturated follows.

Not moisture but a solvent is removed from the dripped toner of the present invention. Even when a solvent is removed, the same phenomena occur and a de-solvent in the period B→C is called constant-rate drying and a de-solvent in the period C→E is called falling-rate drying in the present invention.

In addition, de-solvent is occasionally called drying.

Methods of dripping a toner constituent liquid through a nozzle include a method of discharging a droplet from a nozzle upon application of an oscillating pressure to the toner constituent liquid, a method of discharging a droplet from a nozzle in the shape of a column with an oscillation chamber or an oscillation orifice, etc. Hereinafter, methods of dripping are called spraying.

A toner preparation apparatus for use in the method of preparing a toner of the present invention is not particularly limited, provided that the apparatus is capable of preparing a toner by a spraying and drying method. The toner preparation apparatus includes a dripper discharging a toner constituent solution or dispersion including at least a resin and a colorant to form a droplet, and a solvent remover removing the solvent from the droplet, in which the solvent remover uses steam as a drying gas for a constant-rate drying.

The drippers include, but are not limited to, the following (1) to (4):

(1) a dripper using multiple fluid nozzles spraying a solution or a dispersion with air;

(2) a dripper using a nozzle spraying a solution or a dispersion with piezoelectric pulse;

(3) a dripper discharging a toner constituent liquid into a granulating space from plural through-bores formed on a reservoir reserving the toner constituent liquid while oscillating the toner constituent liquid through the reservoir with an oscillator contacting a part of the reservoir to form a droplet of the toner constituent liquid from the shape of a column through a constricted shape, and changing the droplet into a solid particle in the granulating space; and (4) a dripper periodically discharging a toner constituent liquid with a mechanical oscillator from a thin film having plural nozzles formed on a reservoir reserving the toner constituent liquid.

The drippers in (3) and (4) are preferably used. The drippers in (3) and (4) are capable of generating 100 or more droplets with one oscillator at the same time while keeping a constant volume of the individual droplets. Being monodispersed, the resultant toner has no or almost no variation of many properties such as fluidity and chargeability required for a toner conventional toner preparation methods have had. FIG. 1 is the apparatus of (3).

In this apparatus, an oscillator contacts a part of the reservoir and equally oscillates the toner constituent liquid at the same time through the reservoir to generate a pressure dilatational wave. The toner constituent liquid discharged from a through-bore is constricted at a constant interval and a constant amount of droplet is separated from the toner constituent liquid to form a monodispersed spherical toner.

It is more preferable that the toner constituent liquid is mechanically and periodically discharged from a thin film having plural nozzles formed on the reservoir in (4).

Hereinafter, this will be explained in detail.

The thin film having plural nozzles is mechanically oscillated to discharge the toner constituent liquid from the nozzle to form a droplet thereof. The mechanical oscillation means may be located at any position, provided that it vertically oscillates the thin film. The following two methods are preferably used.

One is a method of using a longitudinal mechanical oscillator having an oscillation surface parallel to the thin film having plural nozzles and vertically oscillating the film. The other is a method of using a circular mechanical oscillator circularly formed on the circumference of the thin film having plural nozzles.

Hereinafter, each of the methods will be explained.

Figure 2:
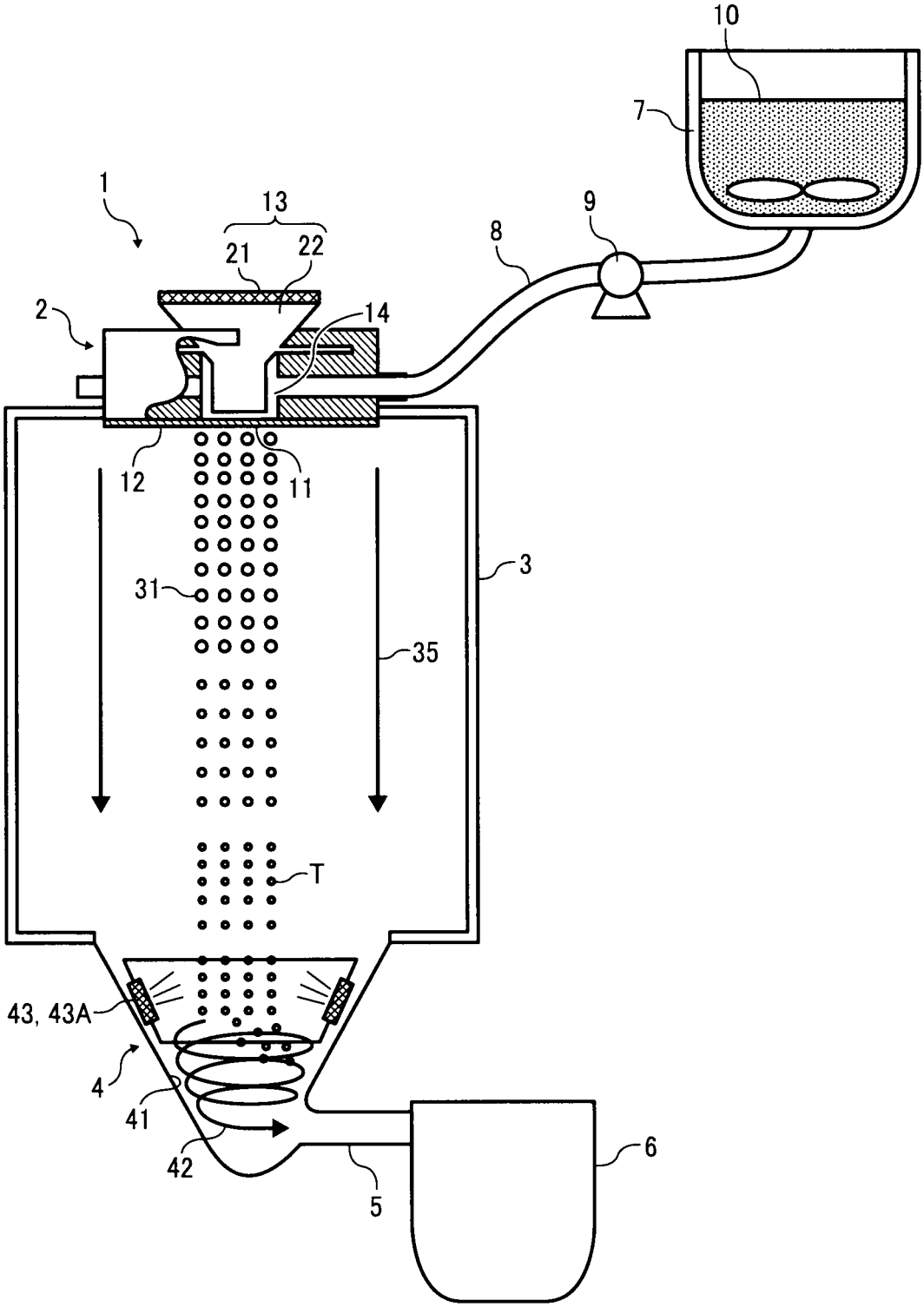
FIG. 2 is a schematic view illustrating another embodiment of the toner preparation apparatus of the present invention.

First, an embodiment of a toner preparation apparatus using the longitudinal mechanical oscillator will be explained, referring to FIG. 2.

A toner preparation apparatus 1 includes a droplet spray unit 2 as a dripper dripping a toner constituent liquid including at least a resin and a colorant to discharge a droplet thereof; a granulator 3 solidifying the droplet from the droplet spray unit 2 located above to form toner particles T; a toner collector 4 collecting the toner particles T; a toner storage storing the toner particles T transferred through a tube 5 from the toner collector 4; a material container 7 containing the toner constituent liquid 10; a liquid feeding pipe 8 feeding the toner constituent liquid 10 from the material container 7 to the droplet spray unit 2; and a pump 9 pumping the toner constituent liquid 10 through the liquid feeding pipe 8.

The toner constituent liquid 10 from the material container 7 is automatically fed to the droplet spray unit 2. The pump 9 subsidiarily assists feeding the liquid. The toner constituent liquid 10 is a toner constituent solution or a dispersion including a solvent, and at least a resin and a colorant dissolved or dispersed therein.

Figure 3:
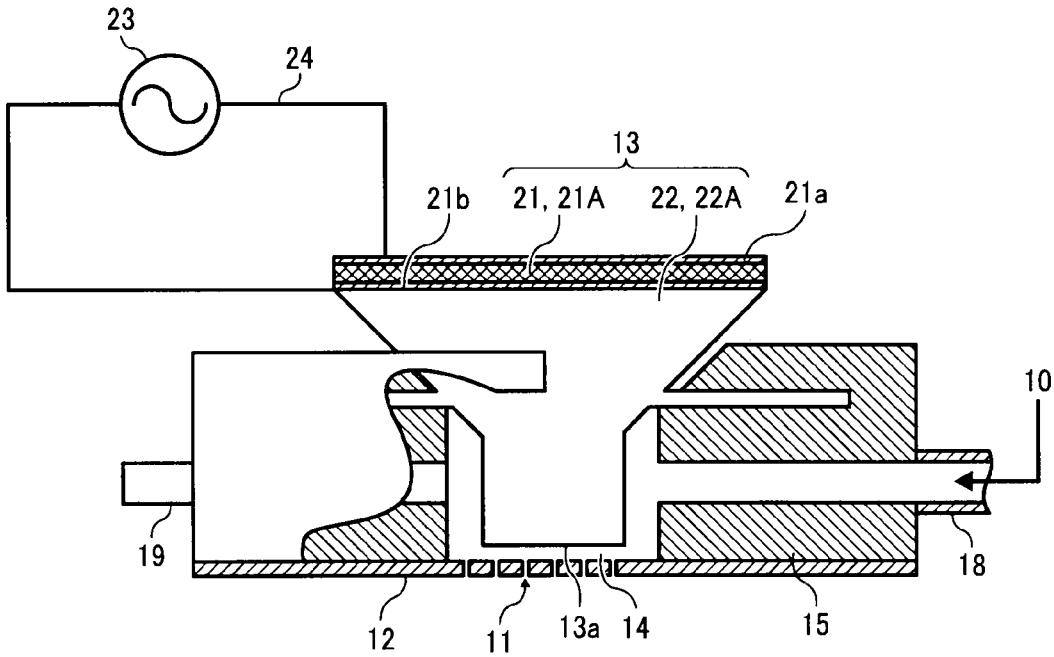
FIG. 3 is an enlarged view of an embodiment of a droplet spray unit of the toner preparation apparatus in FIG. 2.
Figure 4:
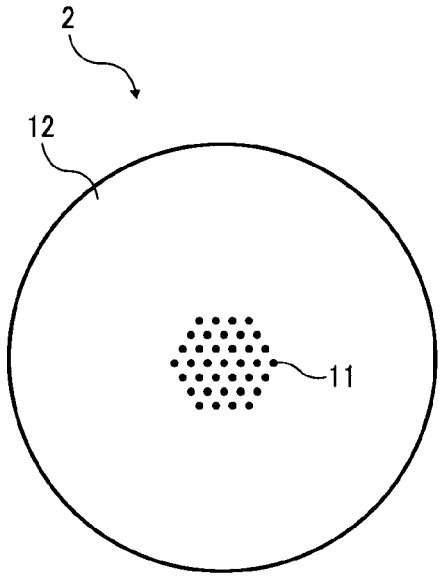
FIG. 4 is a bottom view of the droplet spray unit in FIG. 3.

Next, the droplet spray unit 2 will be explained, referring to FIGS. 3 and 4. FIG. 3 is an enlarged view of an embodiment of a droplet spray unit of the toner preparation apparatus in FIG. 2, and FIG. 4 is a bottom view of the droplet spray unit in FIG. 3.

The droplet spray unit 2 includes a thin film 12 having plural nozzles (discharge openings); an oscillator 13 oscillating the thin film 12; and a flow path member 15 forming a reservoir (liquid flow path) 14 retaining the toner constituent liquid 10 including at least a resin and a colorant between the thin film 12 and the oscillator 13.

The thin film 12 having plural nozzles 11 is located parallel to an oscillation surface 13*a* of the oscillator 13.

A part of the thin film 12 is fixed on the flow path member 15 with a solder or a binder resin insoluble in the toner constituent liquid, and is substantially located perpendicular to the oscillation direction of the oscillator 13. A communicator 24 is arranged to apply an electrical signal to an upper surface and a bottom surface of an oscillation generator 21 to the oscillator 13, and converts a signal from a drive signal generator 23 into a mechanical oscillation. A lead wire, the surface of which is insulatively coated is preferably used as the communicator 24 applying an electrical signal. Various horn oscillators and bolted Langevin type oscillators having large amplitudes mentioned later are preferably used as the oscillator 13 to efficiently and stably prepare a toner.

The oscillator 13 includes an oscillation generator 21 and an oscillation amplifier 22 amplifying an oscillation generated by the oscillation generator 21. A drive circuit (derive signal generator) 23 applies a drive voltage (drive signal) having a required frequency between electrodes 21*a* and 21*b* of the oscillation generator 21 to excite an oscillation thereof. The oscillation is amplified by the oscillation amplifier 22 and an oscillation surface 13*a* periodically oscillates to oscillate the thin film 12 at a required frequency.

The oscillator 13 is not particularly limited, provided it can vertically oscillate the thin film 12 at a constant frequency. The oscillation generator 21 preferably includes a bimorph piezoelectric body 21A exciting a flexural oscillation for oscillating the thin film 12. The piezoelectric body 21A converts an electrical energy to a mechanical energy. Specifically, when a voltage is applied to the piezoelectric body 21A, a flexural oscillation is excited to oscillate the thin film 12.

Specific examples of the piezoelectric body 21A forming the oscillation generator 21 include piezoelectric ceramics such as lead zirconate titanate (LZT). The piezoelectric ceramics are typically layered because of having a small displacement. Besides, piezoelectric polymers such as polyvinylidenefluoride (PVDF) and single crystals such as quartz, $LiNbO_3$, $LiTaO_3$ and $KNbO_3$ are preferably used.

The oscillator 13 is located anywhere, provided it can vertically oscillate the thin film 12 having the nozzle 11. The oscillation surface 13*a* and the thin film 12 are parallely located each other.

A horn oscillator can be used as the oscillator 13 formed of the oscillation generator 21 and the oscillation amplifier 22. Since the horn oscillator amplifies an oscillation of the oscillation generator 21 such as a piezo element with a horn 22A as the oscillation amplifier 22, a mechanical load thereon is not so large that the horn oscillator has a long life.

Figure 5:
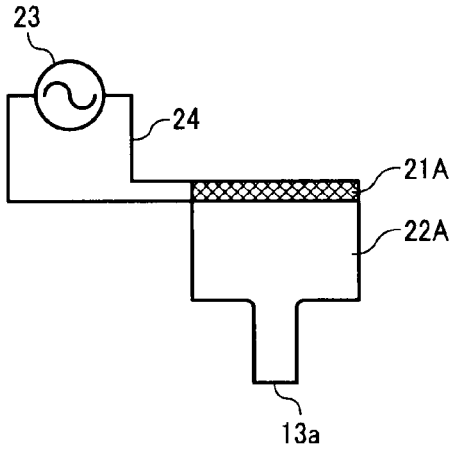
FIG. 5 is a schematic view illustrating a step-shaped horn oscillator forming an embodiment of the oscillation generator of the droplet spray unit in FIG. 3.
Figure 6:
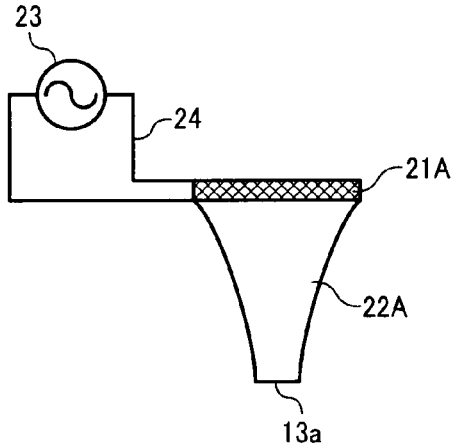
FIG. 6 is a schematic view illustrating an exponential horn oscillator forming another embodiment of the oscillation generator of the droplet spray unit in FIG. 3.
Figure 7:
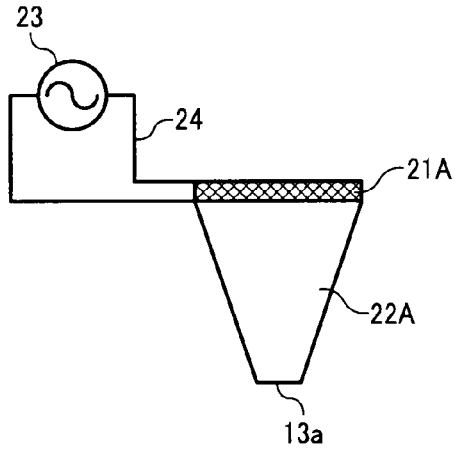
FIG. 7 is a schematic view illustrating a conical horn oscillator forming a further embodiment of the oscillation generator of the droplet spray unit in FIG. 3.

The horn oscillator may have any known shapes of horns such as a step type in FIG. 5, an exponential type in FIG. 6 and a conical type on FIG. 7. The piezoelectric body 21A is located on the surface having a larger area of the horn 22A. The piezoelectric body 21A induces an efficient oscillation of the horn 22A with longitudinal oscillation, and the horn 22A is designed to have the maximum oscillation surface 13*a* having a smaller area. A lead wire 24 is located above and below the piezoelectric bodies 21A and an AC voltage signal is applied thereto from a drive circuit 23. The shape of the horn oscillator is designed such that the horn oscillator has the maximum oscillation surface 13*a*.

In addition, a particularly high-strength bolted Langevin type oscillator can also be used as the oscillator 13. A mechanically combined piezoelectric ceramics forms the bolted Langevin type oscillator, and which does not break when oscillating at a high amplitude.

The reservoir, mechanical oscillator and thin film will be explained in detail, referring to FIG. 3. At least a liquid feeding tube 18 is connected to the reservoir 14 to feed the toner constituent liquid thereto through liquid flow path. In addition, an air bubble discharge tube 19 can be connected thereto when desired. A holder (not shown) installed on the flow path member 15 holds the droplet spray unit 2 on the ceiling of the granulator 3. The droplet spray unit 2 may be located on the drying side surface or the bottom of the granulator 3.

The oscillator 13 typically becomes larger as the frequency reduces, and may optionally be directly subjected to hole drilling to have a reservoir according to a required frequency. Further, the whole reservoir can efficiently be oscillated. In this case, the oscillation surface is defined as a surface laminated with the thin film having plural nozzles.

Different embodiments of the droplet spray unit 2 will be explained, referring to FIGS. 8 and 9.

Figure 8:
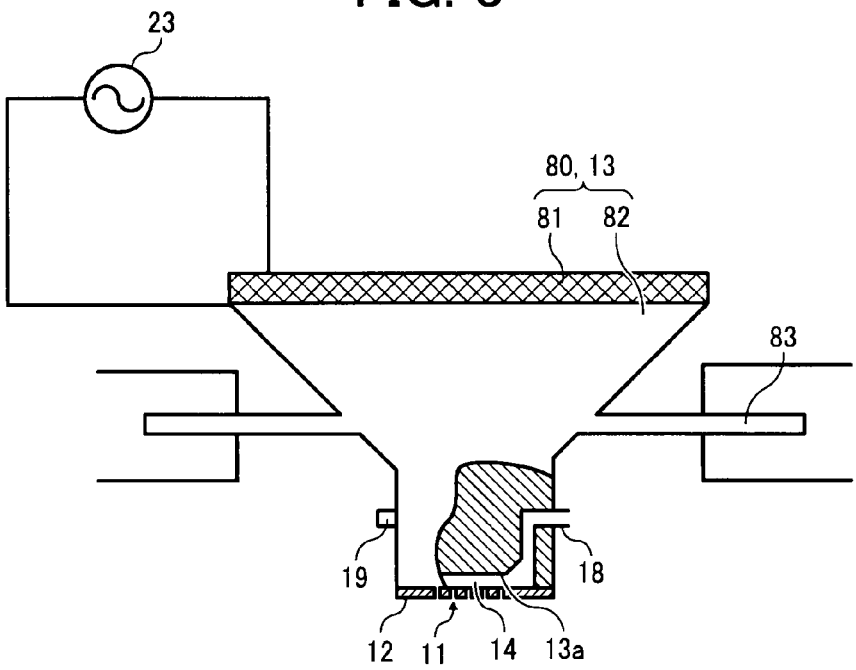
FIG. 8 is an enlarged view of another embodiment of the droplet spray unit of the toner preparation apparatus in FIG. 2.

In FIG. 8, a horn type oscillator 80 formed of a piezoelectric body 81 as an oscillation generator and a horn 82, in which a reservoir (flow path) 14 is partially formed, as an amplifier is used as the oscillator 13. The droplet spray unit 2 is preferably fixed on the drying side surface of the granulator 3 by a flange 83 integrally-formed with the horn 82 of the horn type oscillator 80. In terms of preventing oscillation loss, an elastic body (not shown) can be used to fix the droplet spray unit 2.

Figure 9:
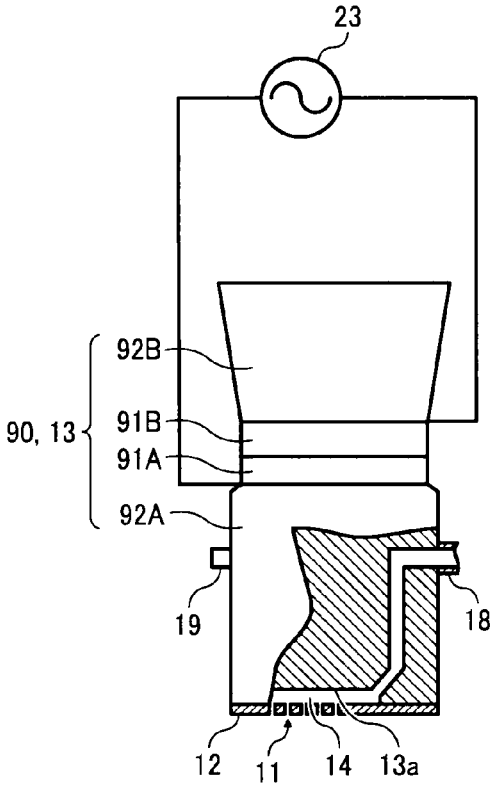
FIG. 9 is an enlarged view of a further embodiment of the droplet spray unit of the toner preparation apparatus in FIG. 2.

In FIG. 9, a bolted Langevin type oscillator 90 formed of piezoelectric bodies 91A and 91B as oscillation generators and horns 92A, in which a reservoir (flow path) 14 is formed, and 92B mechanically and firmly fixed with bolts, as amplifiers is used as the oscillator 13. Frequency conditions occasionally enlarge the piezoelectric body, and as shown in FIG. 9, a fluid inlet/discharge path can be formed in the oscillator and the reservoir can be modified such as a metallic thin film having plural films can be applied to the oscillator 13.

Plurality of the droplet spray units 2 are preferably located above in the granulator 3 (drying tower) in parallel in terms of improving productivity of a toner. The number thereof is preferably from 100 to 1,000 in terms of controllability. In this case, the toner constituent liquid 10 in the material container (common liquid container) 7 is fed through the feeding pipe 8 to the reservoir 14 of each of the droplet spray units 2. The toner constituent liquid 10 from the material container 7 can automatically be fed to the droplet spray unit 2, and the pump 9 subsidiarily can assist feeding the liquid.

Figure 10:
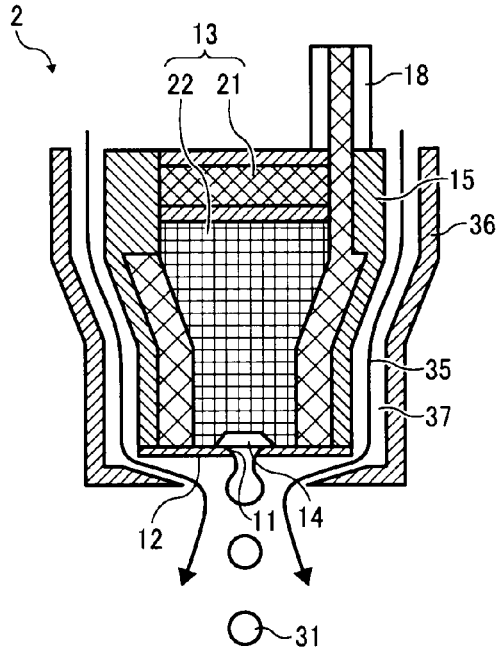
FIG. 10 is an enlarged view of another embodiment of the droplet spray unit of the toner preparation apparatus in FIG. 2.

Another embodiment of the droplet spray unit will be explained, referring to FIG. 10. FIG. 10 is an enlarged view of another embodiment of the droplet spray unit.

Similarly to the above-mentioned embodiment, a droplet spray unit uses a horn oscillator as an oscillation generator 13 and includes a flow path member 15 around the oscillation generator 13 and a reservoir 14 at a position facing a thin film 12 in a horn 22 of the oscillation generator 13. Further, an air flow path forming member 36 forming an air flow path 37 flowing an air stream 35 is located around the flow path member 15 at a required gap between the air flow path forming member 36 and the flow path member 15. In FIG. 10, the thin film 12 has only one nozzle 11 to simplify the drawing, but has plural nozzles as mentioned above.

Figure 11:
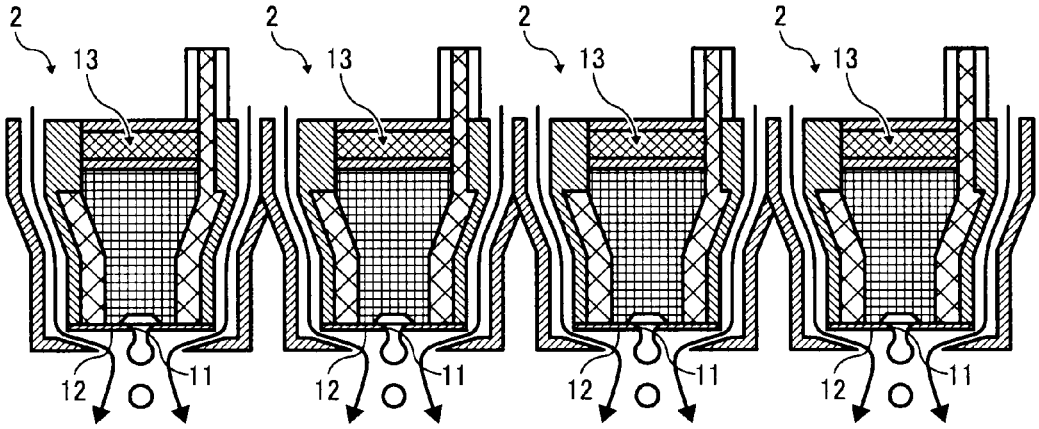
FIG. 11 is schematic view illustrating an arrangement of a plurality of the droplet spray unit in FIG. 10.

Further, as FIG. 11 shows, in order to improve productivity, plural, e.g., 100 to 1,000 pieces of the droplet spray units 2 are preferably located in line at a drying tower reservoir forming a granulator.

Figure 12:
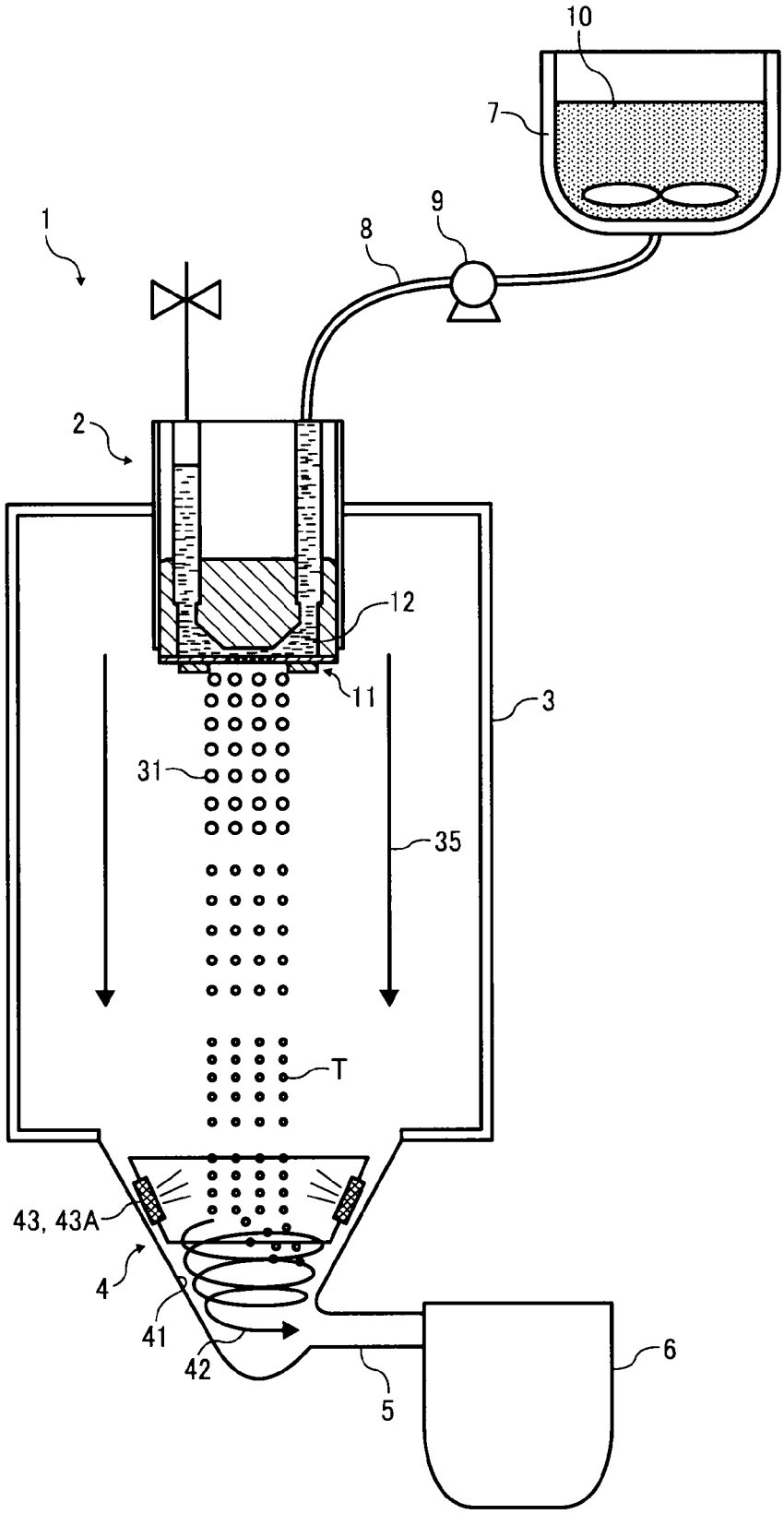
FIG. 12 is a schematic view illustrating a further embodiment of the toner preparation apparatus of the present invention.

FIG. 12 is a schematic view illustrating a further embodiment of the toner preparation apparatus of the present invention, in which the droplet spray unit is replaced with a ring droplet spray unit 2.

Figure 13:
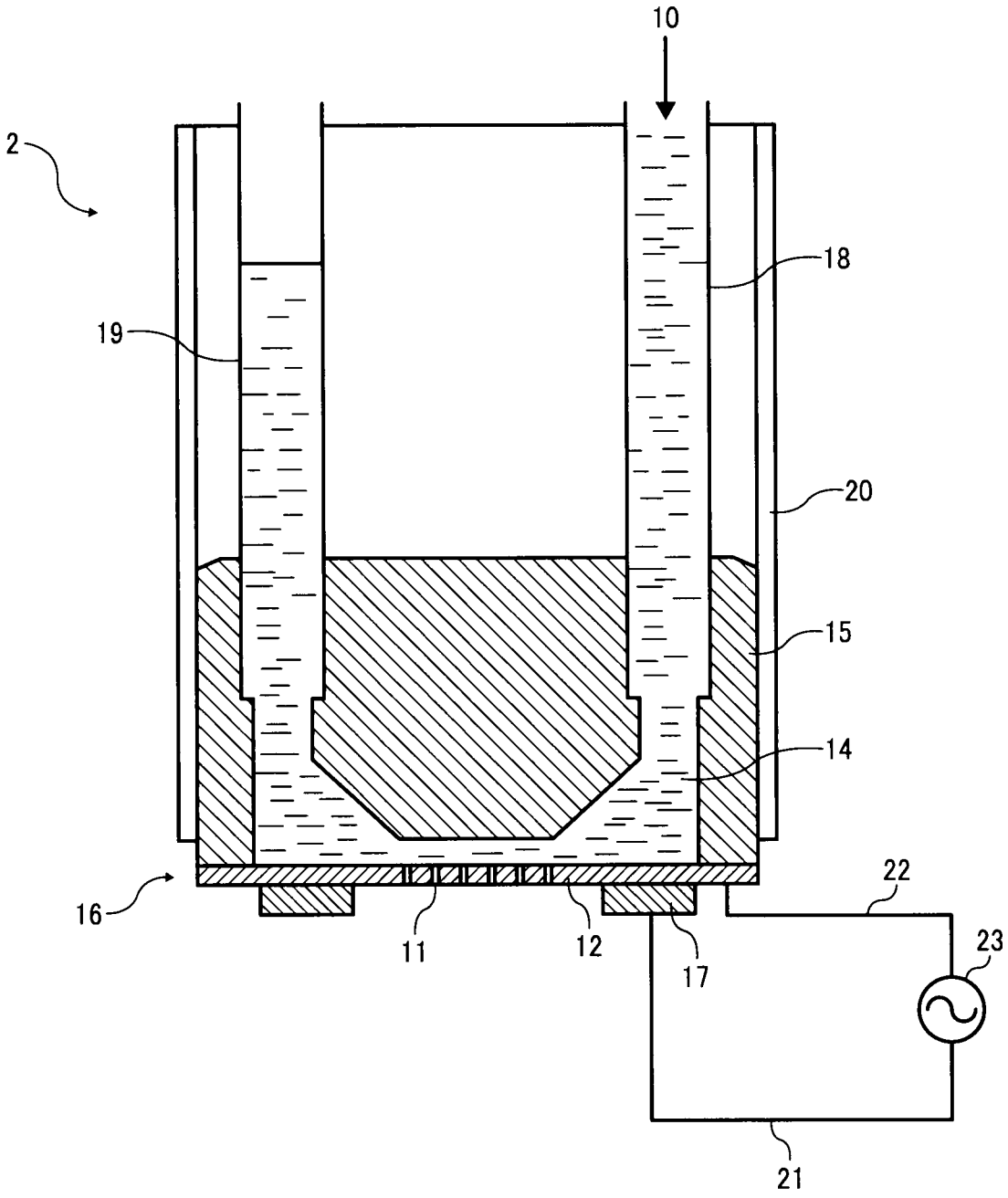
FIG. 13 is an enlarged view of an embodiment of a droplet spray unit of the toner preparation apparatus in FIG. 12.
Figure 14:
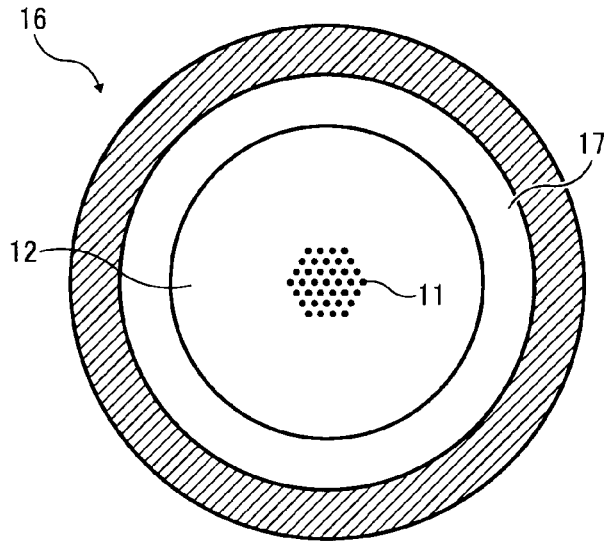
FIG. 14 is a bottom view of the droplet spray unit in FIG. 13.
Figure 15:
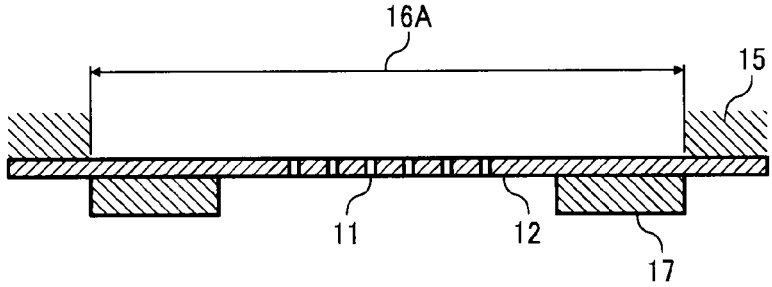
FIG. 15 is an enlarged view of a dripper of the droplet spray unit in FIG. 13.

The ring droplet spray unit 2 will be explained, referring to FIGS. 13 to 15. FIG. 13 is an enlarged view of the droplet spray unit 2 in FIG. 12, FIG. 14 is a bottom view of the droplet spray unit in FIG. 13, and FIG. 15 is an enlarged view of a dripper of the droplet spray unit in FIG. 13.

The droplet spray unit 2 includes a dripper 16 dripping retaining the toner constituent liquid 10 including at least a resin and a colorant, and a flow path member 15 forming a reservoir (liquid flow path) 14 feeding the toner constituent liquid 10 to the dripper 16.

The dripper 16 includes a thin film 12 having plural nozzles (discharge openings) 11 and a circular oscillator (electrical mechanical converter) 17 oscillating the thin film 12. An outermost circumference (a shaded area in FIG. 15) of the thin film 12 is fixed on the flow path member 15 with a solder or a binder resin insoluble in the toner constituent liquid. The circular oscillator 17 is located on the circumference of a deformable area 16A (not fixed to the flow path member 15) of the thin film 12. The circular oscillator 17 is applied with a drive voltage (drive signal) having a required frequency from a drive circuit (drive signal generator) 23 through lead wires 21 and 22 to generate a flexural oscillation.

Figure 16:
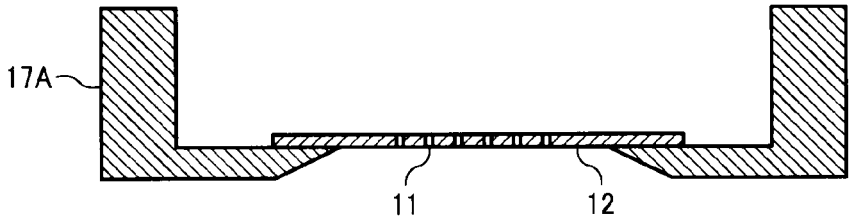
FIG. 16 is an enlarged view of a dripper of Comparative Example.

The dripper 16 including the circular oscillator 17 on the circumference of a deformable area 16A having plural nozzles 11 facing the reservoir 14 has a displacement of the thin film 12 larger than that of a dripper including an oscillator 17A holding the circumference of the thin film 12 in FIG. 16. Plural nozzles 11 are located in comparatively a large area having a diameter not less than 1 mm where the large displacement can be obtained, and droplets stably formed and discharged therefrom.

Figure 17:
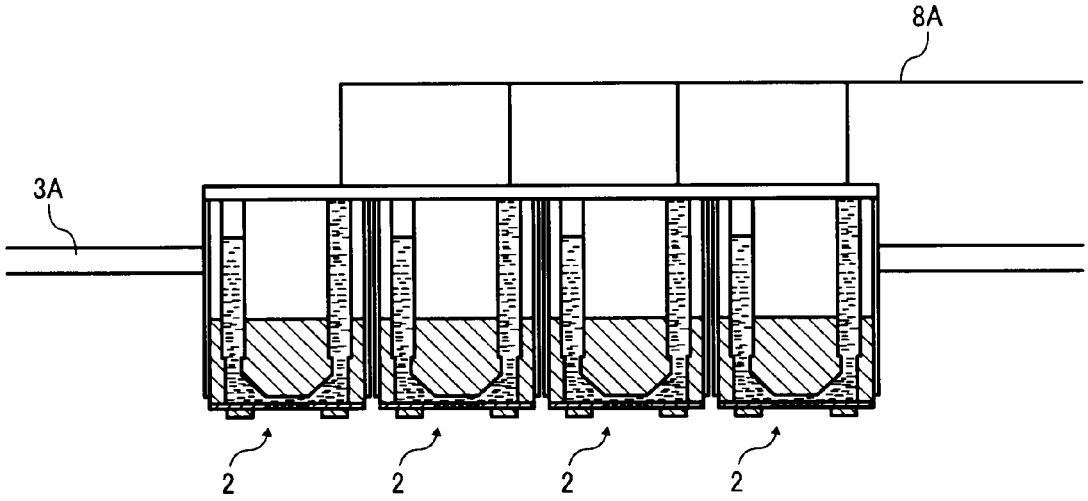
FIG. 17 is a schematic view illustrating a substantial part of the toner preparation apparatus in FIG. 12.

Plurality of the droplet spray units 2 are preferably located on the ceiling 3A in the granulator 3 in terms of improving productivity of a toner. The number thereof is preferably from 100 to 1,000 in terms of controllability as shown in FIG. 17 (only 4 units are shown therein). In this case, the toner constituent liquid 10 in the material container (common liquid container) 7 is fed through the feeding pipe 8A to the reservoir 14 of each of the droplet spray units 2. More droplets can be discharged at the same time to improve the production efficiency.

A droplet forming mechanism by the droplet spray unit 2 will be explained.

As mentioned above, the droplet spray unit 2 transmits a oscillation generated by the oscillator 13 as a mechanical oscillator to the thin film 12 having plural nozzles 11 facing the reservoir 14 to periodically oscillate the thin film 12. The plural nozzles 11 are located in comparatively a large area having a diameter not less than 1 mm, and droplets stably formed and discharged therefrom.

Figure 18A:
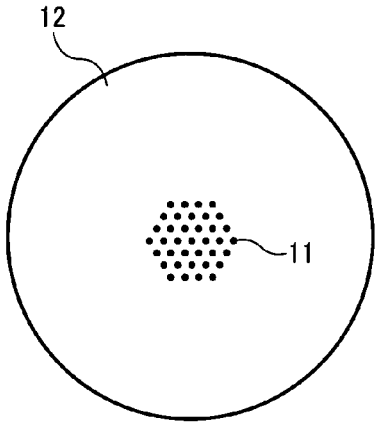
FIGS. 18A and 18B are schematic views illustrating the thin film for explaining the principle of dripping operation by the droplet spray unit in FIG. 13.
Figure 18B:
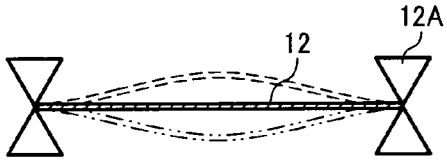
Figure 19:
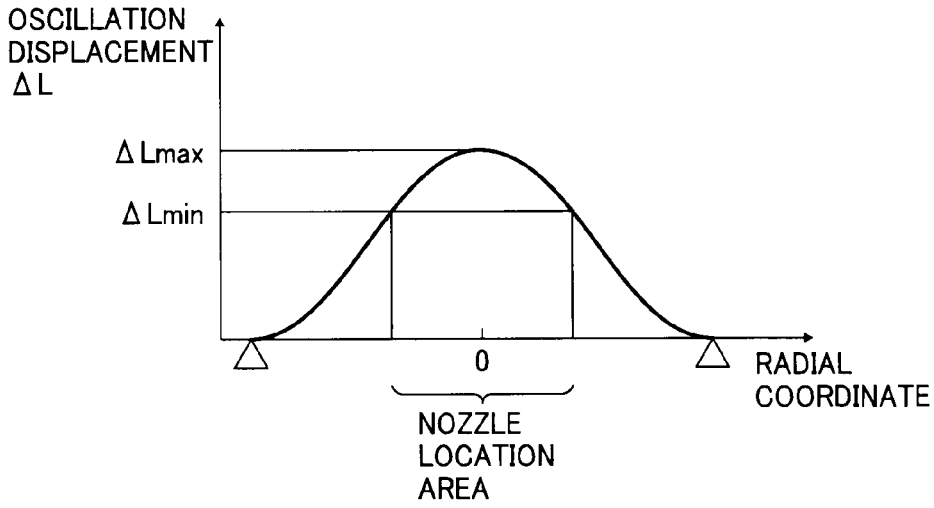
FIG. 19 is an explanatory view of a base oscillation mode of the droplet spray unit in FIG. 13.

When a simple circular thin film 12 having a fixed circumference 12A as shown in FIG. 18B is oscillated, a basic oscillation has a displacement $\Delta L$ becoming maximum ($\Delta L$-max) at the center O of the thin film 12 as shown in FIG. 19 while the circumference is a joint and the thin film 12 periodically oscillates up and down.

Figure 20:
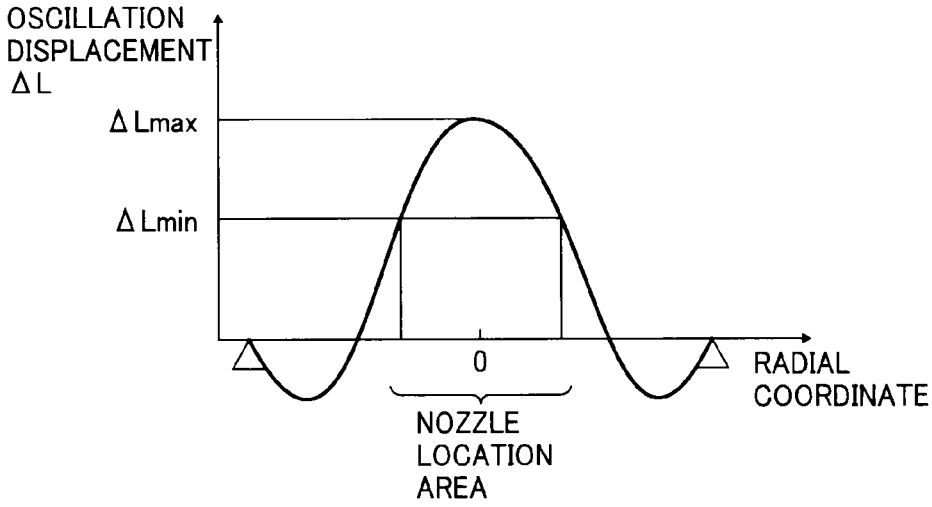
FIG. 20 is an explanatory view of a secondary oscillation mode of the droplet spray unit in FIG. 13.
Figure 21:
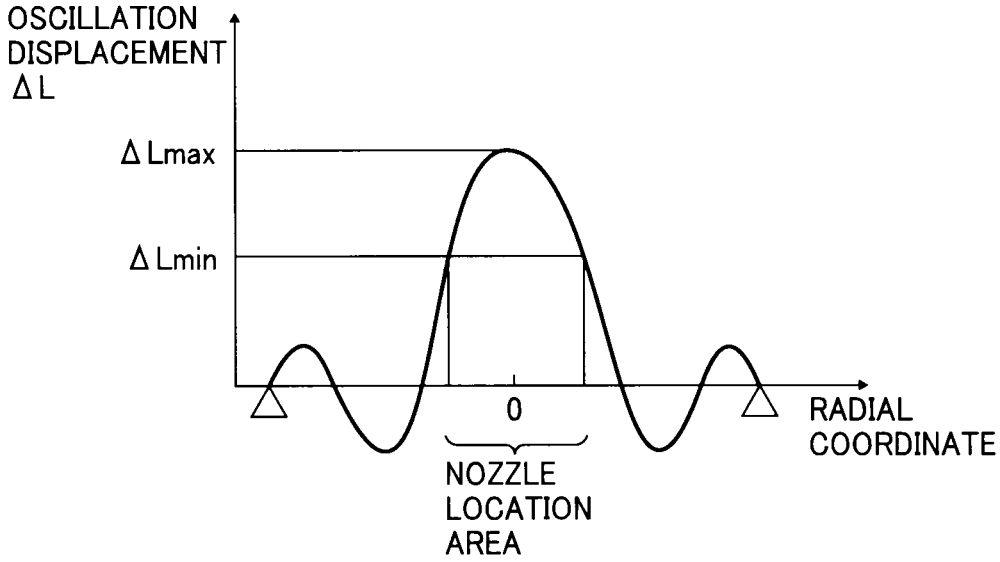
FIG. 21 is an explanatory view of a third oscillation mode of the droplet spray unit in FIG. 13.
Figure 22:
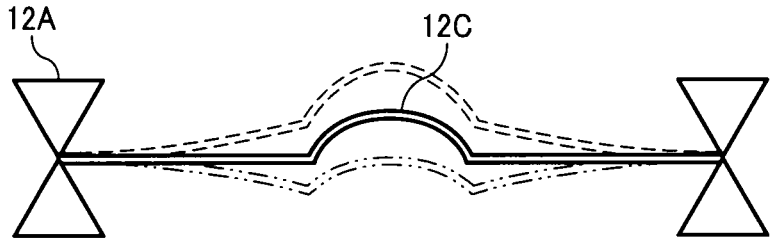
FIG. 22 is a schematic view illustrating the thin film having a convexity at the center of the droplet spray unit in FIG. 13.

As shown in FIGS. 20 and 21, higher oscillation modes are known. These modes concentrically have one or plural joints in a circular thin film 12 and substantially has a symmetric deformed configuration in the radial direction. In addition, as shown in FIG. 22, when the circular thin film 12 has a convex center 12C, a traveling direction of the droplet and the amplitude can be controlled.

When the circular thin film 12 oscillates, the (toner constituent) liquid close to the plural nozzles 11 formed on the circular thin film 12 has a pressure Pac proportional to an oscillation speed Vm of the thin film 12. A sound pressure is known to generate as a radiation impedance Zr of a medium (toner constituent liquid), and the pressure is determined by the following formula:

$$Pac=Zr\cdot Vm \quad (1).$$

The oscillation speed Vm of the thin film 12 is a function of time because of periodically varying with time, and can form various periodical variations such as a sine waveform and a rectangle waveform. In addition, as mentioned above, every part of the thin film 12 has a different oscillation displacement and the oscillation speed Vm is also a function of a position coordinate on the thin film 12. An oscillation form of the thin film 12 is preferably a symmetric deformed configuration in the radial direction as mentioned above, and substantially a function of a radius coordinate.

As mentioned above, an acoustic pressure proportional to an oscillation displacement speed having a distribution of the thin film 12 is generated and the toner constituent liquid 10 is discharged to a gas phase in accordance with a periodical change of the acoustic pressure.

Since the toner constituent liquid 10 periodically discharged to the gas phase becomes spherical due to a difference of surface tensions between the liquid phase and the gas phase, the toner constituent liquid 10 is periodically dripped and discharged from the plural nozzles 11.

The thin film 12 preferably has an oscillation frequency of from 20 kHz to 2.0 MHz, and more preferably from 50 to 500 kHz. The oscillation frequency not less than 20 kHz accelerates dispersion of a pigment and a wax in the toner constituent liquid 10.

Further, the dispersion of a pigment and a wax is more preferably accelerated when the toner constituent liquid 10 has a pressure not less than 10 kPa.

The droplet has a larger diameter as the oscillation displacement in an area where the plural nozzles 11 are formed becomes larger. When the oscillation displacement is small, a small droplet is formed or the toner constituent liquid 10 is not dripped. In order to reduce variation of the droplet sizes in an area where the plural nozzles 11 are formed, the plural nozzles 11 need to be located such that the thin film 12 has the most suitable oscillation displacement.

In the present invention, when the plural nozzles 11 are located such that the oscillation of the thin film 12 the oscillator 13 generates has a ratio R ($\Delta Lmax/\Delta Lmin$) of a maximum ($\Delta Lmax$) to a minimum ($\Delta Lmin$) of the oscillation direction displacement not greater than 2.0 in an area the plural nozzles are formed as shown in FIGS. 19 to 21, i.e., when the plural nozzles 11 are located in an area where R is not greater than 2.0, the droplet size variation can be in a range of toner particle sizes required to produce high-quality images.

Meanwhile, when the toner constituent liquid has a viscosity not greater than 20 mPa·s and surface tension of from 20 to 75 mN/m, a satellite generates. Therefore, the toner constituent liquid 10 preferably has an acoustic pressure not greater than 500 kPa, and more preferably not greater than 100 kPa to prevent the satellite from generating.

The thin film having nozzles is a member discharging a toner constituent solution or dispersion to form a droplet.

The materials of the thin film 12 and the shape of the nozzle 11 are not particularly limited, and it is preferable that the thin film is formed of a metallic plate having a thickness of from 5 to 500 μm and that the nozzle has an opening diameter of from 3 to 35 μm in terms of spraying microscopic droplets of the toner constituent liquid 10 having a uniform diameter from the nozzle 11. The opening diameter of the nozzle 11 is a diameter for a perfect circle and a minor diameter for an ellipse. The number of the nozzles is preferably from 2 to 3,000.

The solvent remover generates an air stream by flowing steam as a drying gas, which transports a droplet with the stream while removing a solvent from the droplet therein to form a toner. The drying gas is not particularly limited, provided the gas includes steam, and preferably has a relative humidity not less than 85% at a temperature when starting de-solvent and is more preferably a saturated steam. The gas including steam is preferably air, nitrogen gas, etc.

Further, a second de-solvent gas having a dew point not higher than −10° C. can be flowed on the way of removing solvent. The second de-solvent gas dries moisture replaced with the solvent and shortens a time of the following falling-rate drying. The second de-solvent gas is preferably air or nitrogen.

In the constant-rate drying, input temperatures of the first de-solvent gas including steam and the second de-solvent gas having a dew point not higher than −10° C. are set such that a toner collected does not have a temperature not less than 50° C.

The toner preparation apparatus of the present invention can include a falling-rate drier separately from the stream drier. The falling-rate driers include conductive electrical-heating stirring driers, fluidized-bed driers and moving bed driers. The falling-rate drying preferably has a drying temperature lower than a glass transition temperature of the resin or a melting point of the organic low-molecular-weight material, whichever is lower, and more preferably lower by 10° C. or more.

An external additive is mixed with the toner of the present invention when desired. The external additive can be mixed therewith at the same time when the falling-rate drying is performed, which simplifies the preparation process.

The image forming apparatus using the toner of the present invention will be explained.

Figure 25:
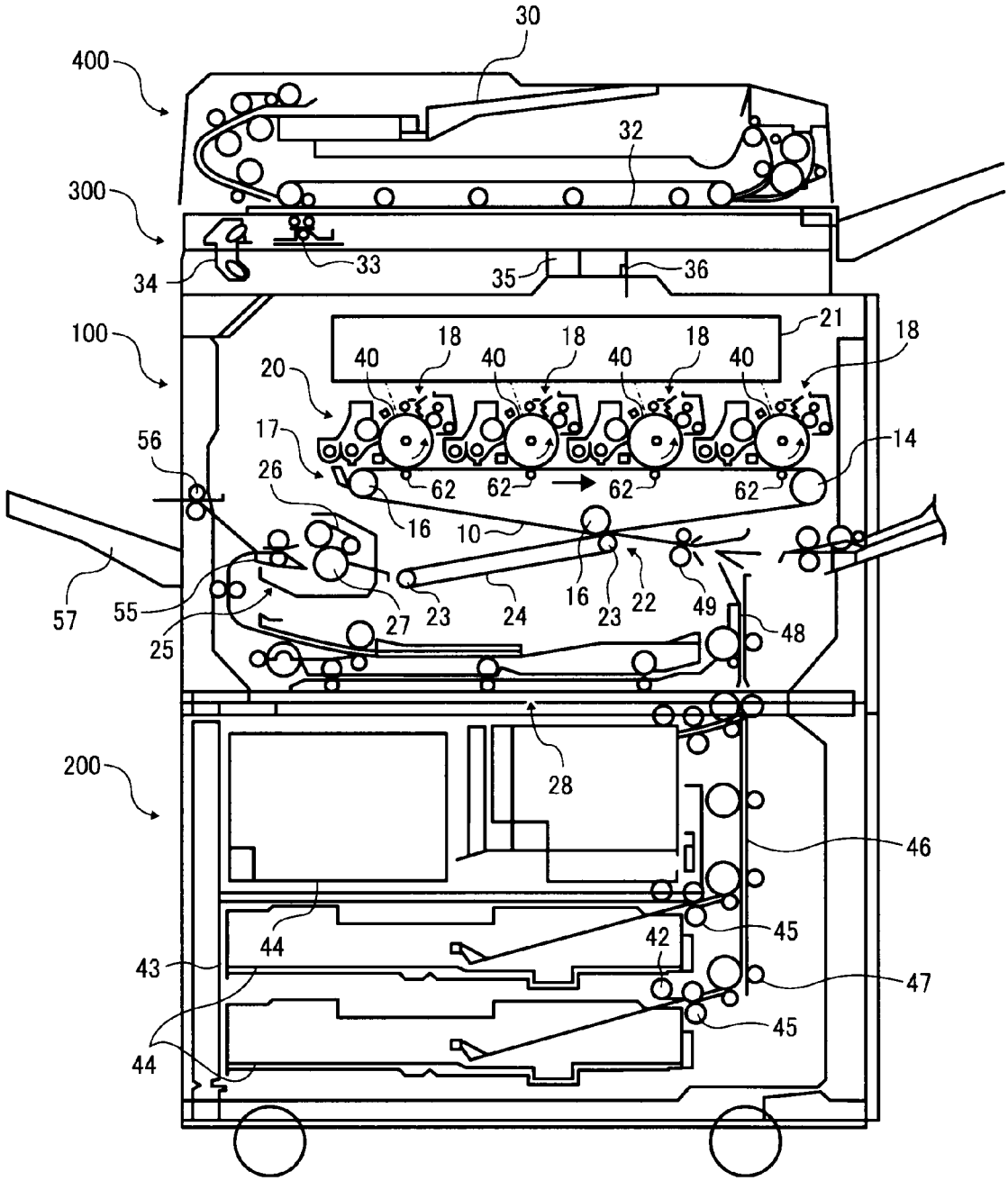
FIG. 25 is a schematic view illustrating a vertical section of an embodiment of the image forming apparatus of the present invention.

FIG. 25 is a schematic view illustrating a vertical section of an embodiment of the tandem full-color image forming apparatus of the present invention, which is not limited thereto, provided it uses a two-component developer.

Numeral 100 is a copier, 200 is a paper feeding table, 300 is a scanner on the copier 100 and 400 is an automatic document feeder (ADF) on the scanner 300. The copier 100 includes an intermediate transferer 10 having the shape of an endless belt.

As shown in FIG. 25, the intermediate transferer 10 is suspended by three suspension rollers 14, 15 and 16 and rotatable in a clockwise direction.

On the left of the suspension roller 15, an intermediate transferer cleaner 17 is located to remove a residual toner on an intermediate transferer 10 after an image is transferred.

Above the intermediate transferer 10, 4 image forming units 18 for yellow, cyan, magenta and black colors are located in line from left to right along a transport direction of the intermediate transferer 10 to form a tandem image former 20.

Above the tandem image former 20, an image developer 21 is located as shown in FIG. 25. On the opposite side of the tandem image former 20 across the intermediate transferer 10, a second transferer 22 is located. The second transferee 22 includes a an endless second transfer belt 24 and two rollers 23 suspending the endless second transfer belt 24, and is pressed against the suspension roller 16 across the intermediate transferee 10 and transfers an image thereon onto a sheet.

Beside the second transferer 22, a fixer 25 fixing a transferred image on the sheet is located. The fixer 25 includes an endless belt 26 and a pressure roller 27 pressed against the belt.

The second transferer 22 also includes a function of transporting the sheet an image is transferred on to the fixer 25. As the second transferer 22, a transfer roller and a non-contact charger may be used. However, they are difficult have such a function of transporting the sheet.

In FIG. 25, below the second transferer 22 and the fixer 25, a sheet reverser 28 reversing the sheet to form an image on both sides thereof is located in parallel with the tandem image former 20.

An original is set on a table 30 of the ADF 400 to make a copy, or on a contact glass 32 of the scanner 300 and pressed with the ADF 400.

When a start switch (not shown) is put on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the original.

When a start switch (not shown) is put on, a drive motor (not shown) rotates one of the suspension rollers 14, 15 and 16 such that the other two rollers are driven to rotate, to rotate the intermediate transferer 10. At the same time, each of the image forming units 18 rotates the photoreceptor 40 and forms a single-colored image, i.e., a black image, a yellow image, a magenta image and cyan image on each photoreceptor 40. The single-colored images are sequentially transferred onto the intermediate transferer 10 to form a full-color image thereon.

On the other hand, when start switch (not shown) is put on, one of paper feeding rollers 42 of paper feeding table 200 is selectively rotated to take a sheet out of one of multiple-stage paper cassettes 44 in a paper bank 43. A separation roller 45 separates sheets one by one and feed the sheet into a paper feeding route 46, and a feeding roller 47 feeds the sheet into a paper feeding route 48 of the copier 100 to be stopped against a registration roller 49.

Alternatively, a paper feeding roller 50 is rotated to take a sheet out of a manual feeding tray 51, and a separation roller 52 separates sheets one by one and feed the sheet into a paper feeding route 53 to be stopped against a registration roller 49.

Then, in timing with a synthesized full-color image on the intermediate transferer 10, the registration roller 49 is rotated to feed the sheet between the intermediate transferer 10 and the second transferer 22, and the second transferee transfers the full-color image onto the sheet.

The sheet the full-color image is transferred thereon is fed by the second transferer 22 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the backside of the sheet, and then the sheet is discharged by the discharge roller 56 onto the catch tray 57.

On the other hand, the intermediate transferer 10 after transferring an image is cleaned by the intermediate transferer cleaner 17 to remove a residual toner thereon after the image is transferred, and ready for another image formation by the tandem image former 20.

Figure 26:
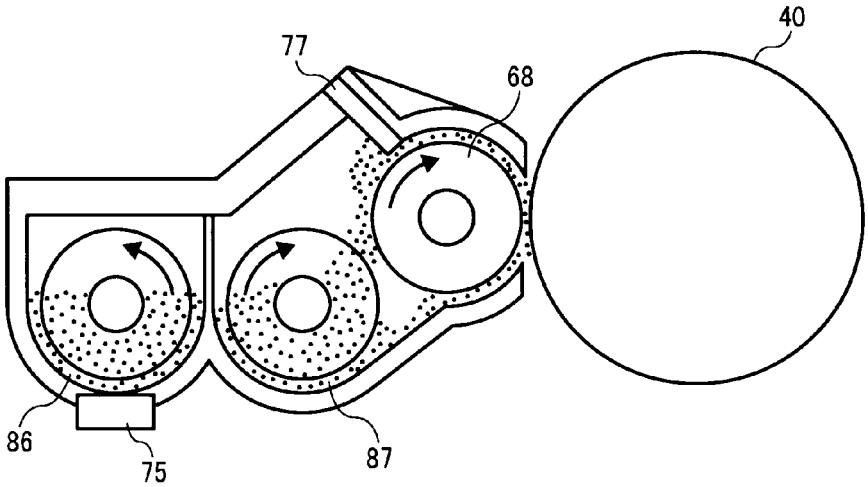
FIG. 26 is a schematic enlarged view illustrating a vertical section of an image developer in the image forming apparatus in FIG. 25.

In the tandem image former 20, each of the image forming units 18 includes a charger 60, an image developer 61, a first transferer 62, a photoreceptor cleaner 63, a discharger 64, etc. around a drum-shaped photoreceptor 40. The photoreceptor cleaner 63 includes at least a blade cleaning member. The image developer 61 includes a toner-feeding-side stirring chamber 86, a developing-side stirring chamber 87, a developing sleeve 68, a toner concentration sensor 75 and a doctor blade 77 as a developer stirrer and transporter as shown in FIG. 26. The outer wall of the toner-feeding-side stirring chamber 86 has a feed opening (not shown) and a toner is fed therethrough from a toner feeder (not shown). A stirring screw in the toner-feeding-side stirring chamber 86 stirs a toner fed from the toner feeder with a developer (two-component developer including a magnetic carrier and a toner) therein and transports the developer. A stirring screw in the developing-side stirring chamber 87 stirs and transports the developer therein.

Figure 27:
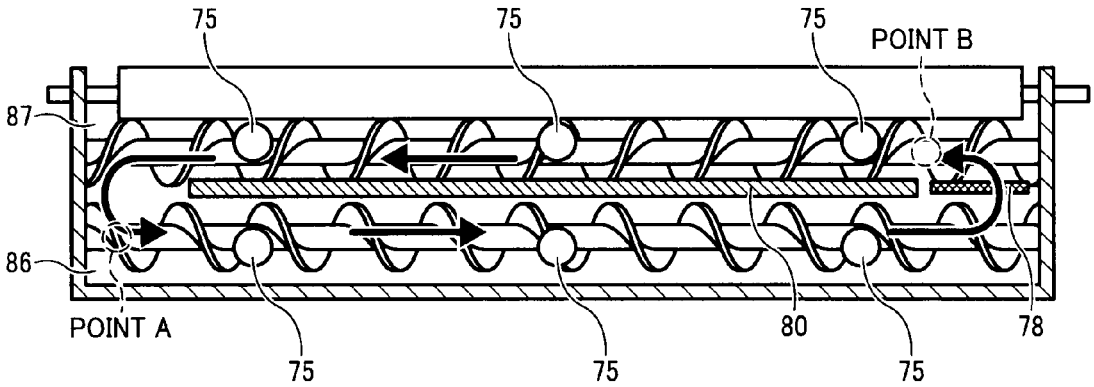
FIG. 27 is a schematic partially-enlarged view illustrating a vertical section of the image developer in FIG. 26.

The toner-feeding-side stirring chamber 86 and the developing-side stirring chamber 87 are divided with a division board 80 as shown in FIG. 27, and openings from which the developer is taken out and in are located at both ends. The developer in the developing-side stirring chamber 87 is taken out on the developing sleeve 68, and an amount thereof is regulated with the doctor blade 77 and fed to a scraped position with a latent image bearer. The doctor blade applies the largest scraping force to the developer then.

Figure 28:
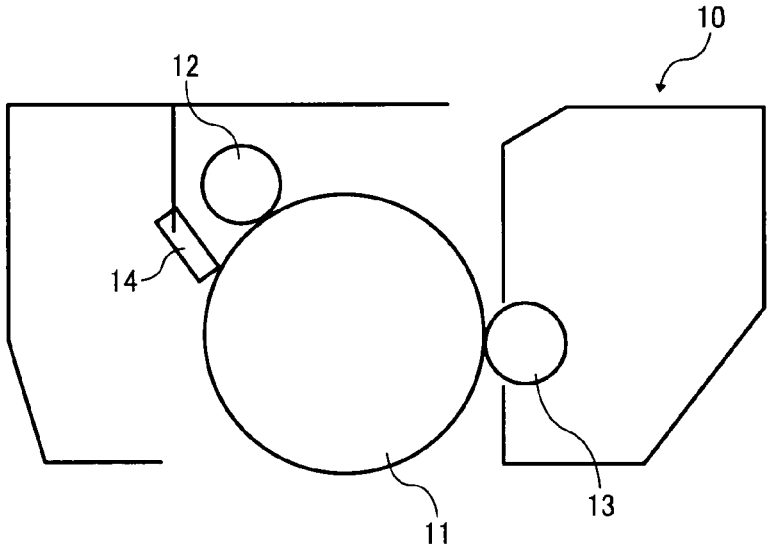
FIG. 28 is a schematic view illustrating the process cartridge of the present invention.

FIG. 28 is a schematic view illustrating the process cartridge of the present invention. In FIG. 28, numeral 10 is a whole process cartridge, 11 is a photoreceptor, 12 is a charger, 13 is an image developer and 14 is a cleaner.

In the present invention, at least plurality of the photoreceptor 11, the charger 12, the image developer 13 and the cleaner 14 are combined in a body as a process cartridge detachable from an image forming apparatus such as a copier and a printer.

In an image forming apparatus using the process cartridge of the present invention, the photoreceptor rotates at a predetermined peripheral speed. A peripheral surface of the photoreceptor is positively or negatively charged uniformly by a charger while the photoreceptor is rotating to have a predetermined potential. Next, the photoreceptor receives an imagewise light from an irradiator, such as a slit irradiator and a laser beam scanner to form an electrostatic latent image on the peripheral surface thereof. Then, the electrostatic latent image is developed by an image developer with a toner to form a toner image. Next, the toner image is transferred onto a transfer material fed between the photoreceptor and a transferer from a paper feeder in synchronization with the rotation of the photoreceptor. Then, the transfer material which received the toner image is separated from the surface of the photoreceptor and led to an image fixer fixing the toner image on the transfer material to form a copy image which is discharged out of the apparatus. The surface of the photoreceptor is cleaned by a cleaner to remove a residual toner after transfer, and is discharged to repeat forming images.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Colorant Dispersion

First, a carbon black dispersion was prepared.

16 parts of carbon black (Regal 1400 from Cabot Corp.), 4 parts of a pigment dispersant (AJISPER PB821 from Ajinomoto Fine-Techno Co., Inc.) and 80 parts of ethylacetate were primarily dispersed by a mixer having a stirring blade to prepare a primary dispersion. The primary dispersion was more dispersed with higher shearing strength by a dyno-mill to prepare a secondary dispersion completely free from aggregates. Further, the secondary dispersion was passed through a filter made of PTFE having a pore size of 1 μm to prepare a sub-micron dispersion.

(Preparation of Wax Dispersion)

Next, a dispersion including a binder resin and a wax was prepared.

14 parts of a polyester resin (RN-300 from Kao Corp.) as a binder resin, 10 parts of paraffin wax (HP-11) and 6 parts of a wax dispersant from Sanyo Chemical Industries, Ltd. were mixed in 80 parts of ethylacetate by a mixer having a stirring blade for 10 min, and further dispersed by a dyno-mill to prepare a dispersion. The dispersion was further passed through a filter made of PTFE having a pore size of 1 μm.

(Preparation of Toner Constituent Liquid A)

| | |
|---|---|
| Colorant Dispersion: | 50 |
| Wax Dispersion: | 50 |
| Binder Resin: | 90 |
| (styrene-acrylic resin NCI 10B-85 having a weight-average molecular weight (MW) of 8,500 from Nippon Carbide Industries Co., Inc.) | |
| Ethylacetate: | 720 |

(Preparation of Toner Constituent Liquid B)

| | |
|---|---|
| Colorant Dispersion: | 50 |
| Wax Dispersion: | 50 |
| Binder Resin: | 90 |
| (polyester resin RN-300 having a weight-average molecular weight (MW) of 14,000 Kao Corp.) | |
| Ethylacetate: | 720 |

(Preparation of Toner Constituent Liquid C)

| | |
|---|---|
| Colorant Dispersion: | 50 |
| Wax Dispersion: | 50 |
| Binder Resin: | 70 |
| (polyester resin RN-300 having a weight-average molecular weight (MW) of 14,000 Kao Corp.) | |
| Binder Resin: | 20 |
| (styrene-acrylic resin NCI 10B-85 having a weight-average molecular weight (MW) of 8,500 from Nippon Carbide Industries Co., Inc.) | |
| Ethylacetate: | 720 |

(Preparation of Toner Constituent Liquid D)

| | |
|---|---|
| Colorant Dispersion: | 50 |
| Wax Dispersion: | 50 |
| Binder Resin: | 90 |
| (polyester resin RN-104 having a weight-average molecular weight (MW) of 50,000 Kao Corp.) | |
| Ethylacetate: | 720 |

The following toners A1 to A3, B1 to B3, C1 to C3 and D1 to D3 were prepared by the following 3 methods using the toner constituent liquids A to D. All of the toners were monodispersed toners having an average particle diameter of 5.8 μm.

Example 1

Preparation Method 1

Figure 23:
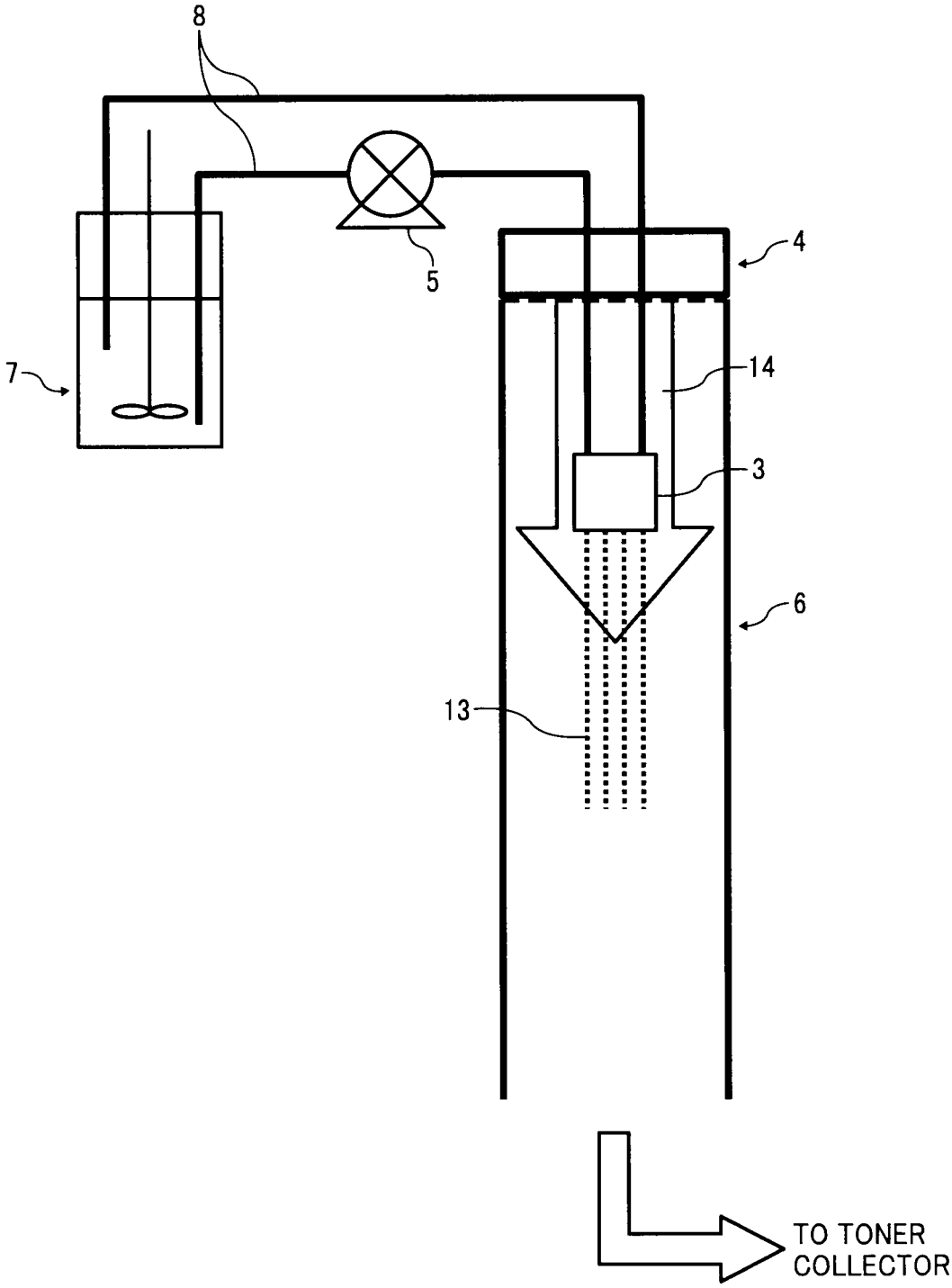
FIG. 23 is a schematic view illustrating the toner preparation apparatus used in Example 1.

After the toner preparation apparatus in FIG. 23 having a reservoir reserving a toner constituent liquid and a sprayer formed on the reservoir, using a horn type oscillator nozzle head periodically discharging the toner constituent liquid with a mechanical oscillator from a thin film having plural nozzles in FIG. 3, sprayed and dried the toner constituent liquid, the toner constituent liquid was further dried at a falling rate by a fluidized-bed drier in an environment of 50° C. to prepare the toners A1 to D1.

The drying gas was steam having a temperature of 50° C. and a relative humidity of 85%. The sprayer using the horn type oscillator nozzle head sprayed the toner constituent liquid at 10 g/min.

The residual solvent values and solid contents of the toners A1 to D1 after dried at a falling rate are shown in Table 1.

As an evaluation standard, the residual solvent value less than 50 ppm was ◎, from 50 ppm less than 100 ppm was ○, from 100 ppm less than 200 ppm was Δ and not less than 200 ppm was X. When not less than 200 ppm, the toner emits a foul odor and causes problems such as filming over a photoreceptor.

The thin film was a nickel plate having an outer diameter of 8.0 mm and a thickness of 20 μm, on which spherical nozzles having a diameter of 8 μm are formed by an electroforming method. The nozzles are formed at the center having a diameter about 5 mm of the thin film in the shape of a houndstooth such that each of gaps among the nozzles is 100 μm.

Layered piezoelectric zirconate titanate (PZT) was used as a piezoelectric body and the frequency was 180 KHz.

TABLE 1

| | Solid content after falling rate drying (%) | Residual solvent after falling rate drying (ppm) | Evaluation |
|---|---|---|---|
| Toner A1 | 99.9 | 21 | ◎ |
| Toner B1 | 99.9 | 45 | ◎ |
| Toner C1 | 99.9 | 38 | ◎ |
| Toner D1 | 99.9 | 96 | ○ |

Example 2

Preparation Method 2

Figure 24:
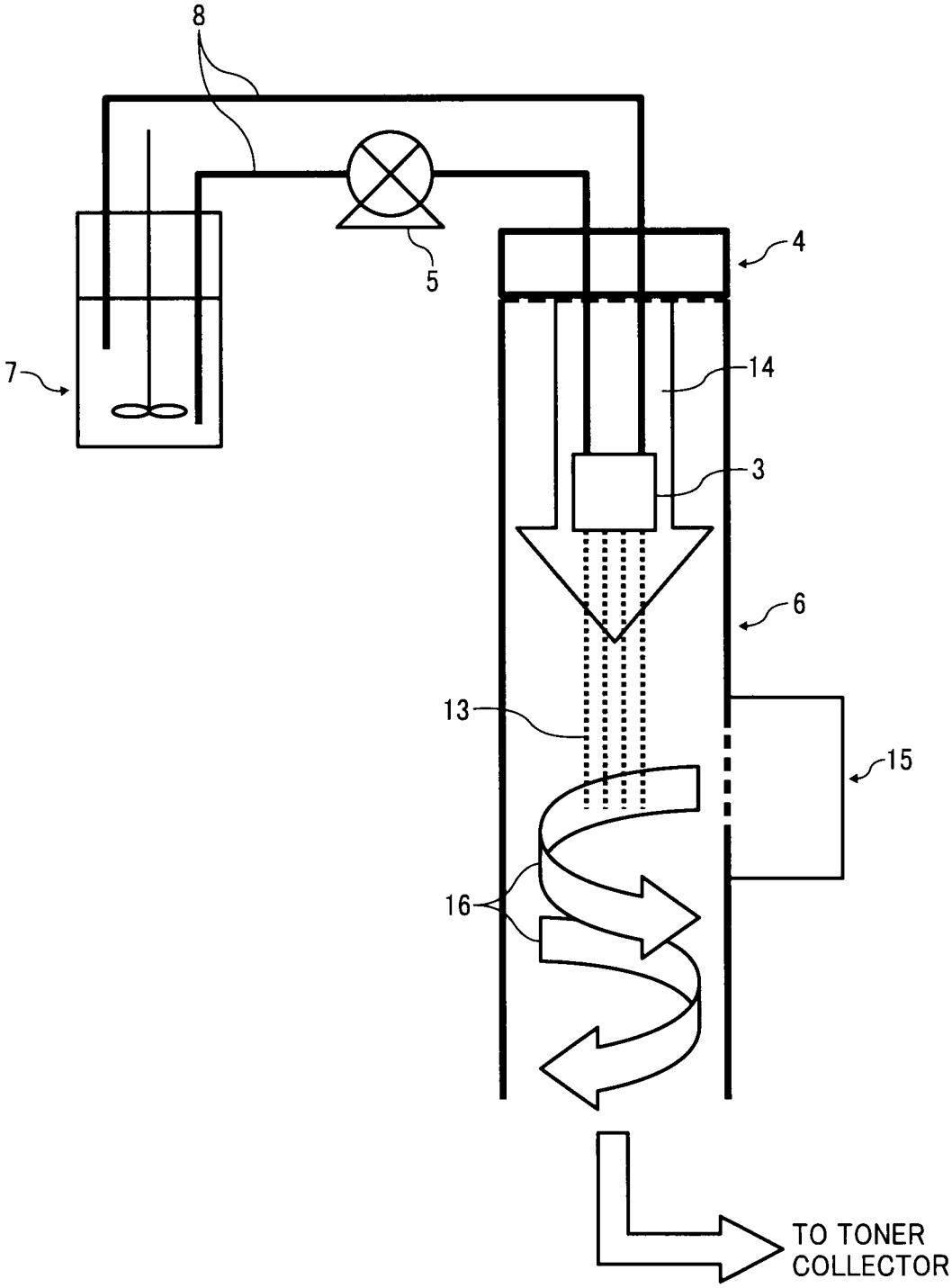
FIG. 24 is a schematic view illustrating the toner preparation apparatus used in Example 2.

After the toner preparation apparatus in FIG. 24 having a reservoir reserving a toner constituent liquid and a sprayer formed on the reservoir, using a horn type oscillator nozzle head periodically discharging the toner constituent liquid with a mechanical oscillator from a thin film having plural nozzles in FIG. 3, sprayed and dried the toner constituent liquid to prepare the toners A2 to D2.

The first drying gas was steam having a temperature of 50° C. and a relative humidity of 95%. The second drying gas was dry air having a temperature of 40° C. and a relative humidity less than 5%. The sprayer using the horn type oscillator nozzle head sprayed the toner constituent liquid at 10 g/min.

The residual solvent values and solid contents of the toners A2 to D2 after dried at a falling rate are shown in Table 2.

Preparation Method 2 can omit falling-rate drying.

The thin film was a nickel plate having an outer diameter of 8.0 mm and a thickness of 20 μm, on which spherical nozzles having a diameter of 8 μm are formed by an electroforming method. The nozzles are formed at the center having a diameter about 5 mm of the thin film in the shape of a houndstooth such that each of gaps among the nozzles is 100 μm.

Layered piezoelectric zirconate titanate (PZT) was used as a piezoelectric body and the frequency was 180 KHz.

TABLE 2

| | Solid content after falling rate drying (%) | Residual solvent after falling rate drying (ppm) | Evaluation |
|---|---|---|---|
| Toner A2 | 99.9 | 47 | ◎ |
| Toner B2 | 99.9 | 89 | ○ |
| Toner C2 | 99.9 | 76 | ○ |
| Toner D2 | 99.9 | 170 | Δ |

Comparative Example 1

Preparation Method 3

The procedures for preparation of the toners A1 to D1 in Example 1 were repeated to prepare the toners A3 to D3 except for replacing the drying gas with dry air having a temperature of 50° C. and a relative humidity less than 5%.

The residual solvent values and solid contents of the toners A3 to D3 after dried at a falling rate are shown in Table 3.

TABLE 3

| | Solid content after falling rate drying (%) | Residual solvent after falling rate drying (ppm) | Evaluation |
|---|---|---|---|
| Toner A3 | 99.9 | 126 | Δ |
| Toner B3 | 99.9 | 876 | X |
| Toner C3 | 99.9 | 783 | X |
| Toner D3 | 99.2 | 7650 | X |

This application claims priority and contains subject matter related to Japanese Patent Application No. 2007-205325 filed on Aug. 7, 2007, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of preparing a toner, comprising:

dripping a toner constituent liquid comprising:

an organic solvent; and toner constituents comprising a resin and a colorant, which are dissolved or dispersed in the organic solvent through a nozzle to form a droplet; and removing the organic solvent from the droplet by contacting the droplet with a first de-solvent gas comprising steam having a humidity not less than 85% in a first stage and a second de-solvent gas having a dew point not greater than −10° C. under ordinary pressure in a second stage.

2. The method of claim 1, wherein the nozzle is an oscillator chamber nozzle head comprising an oscillator which contacts a part of a reservoir reserving the toner constituent liquid and oscillates the toner constituent liquid through the reservoir to discharge the toner constituent liquid in a granulating space from plural through-bores formed on the reservoir and form a droplet of the toner constituent liquid from the shape of a column through a constricted shape, or the nozzle periodically discharges the toner constituent liquid from a thin film having plural nozzles, formed on the reservoir with a mechanical oscillator.

3. The method of claim 2, wherein the mechanical oscillator is circularly formed on the circumference of an area where the nozzles are formed.

4. The method of claim 2, wherein the mechanical oscillator comprises an oscillation surface parallel to the thin film, and vertically and longitudinally oscillates.

* * * * *